US007174581B2

(12) United States Patent
McNerney et al.

(10) Patent No.: US 7,174,581 B2
(45) Date of Patent: Feb. 13, 2007

(54) TOP DOWN MOUNTING SYSTEM FOR A FAUCET

(75) Inventors: Gerald J. McNerney, Carmel, IN (US); Garry Marty, Fishers, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 0 days.

(21) Appl. No.: 11/295,094

(22) Filed: Dec. 6, 2005

(65) Prior Publication Data

US 2006/0080773 A1 Apr. 20, 2006

Related U.S. Application Data

(62) Division of application No. 10/411,432, filed on Apr. 10, 2003, now Pat. No. 7,003,818.

(60) Provisional application No. 60/373,277, filed on Apr. 17, 2002.

(51) Int. Cl.
*E03C 1/042* (2006.01)

(52) U.S. Cl. ..... 4/695; 4/675

(58) Field of Classification Search ..... 4/675–678, 4/695; 137/801
See application file for complete search history.

(56) References Cited

U.S. PATENT DOCUMENTS

| | | | |
|---|---|---|---|
| 1,592,353 | A | 7/1926 | Gade |
| 2,173,064 | A | 9/1939 | Judell |
| 2,591,991 | A | 4/1952 | Young |
| 2,848,721 | A | 8/1958 | Fredrickson |
| 3,010,474 | A | 11/1961 | Moen |
| 3,012,251 | A | 12/1961 | Fife |
| 3,035,276 | A | 5/1962 | Hanson |
| 3,229,710 | A | 1/1966 | Keller, III |
| 3,427,049 | A | 2/1969 | Politz |
| 3,448,768 | A | 6/1969 | Keller, III |
| 3,495,616 | A | 2/1970 | Esposito |
| 3,561,485 | A | 2/1971 | Kingler |
| 3,600,723 | A | 8/1971 | Mongerson et al. |
| 3,609,774 | A | 10/1971 | Allgood |
| 3,645,493 | A | 2/1972 | Manoogian et al. |
| 3,790,966 | A | 2/1974 | Keane |
| 3,796,380 | A | 3/1974 | Johnson et al. |
| 3,807,453 | A | 4/1974 | Dom et al. |
| 3,911,946 | A | 10/1975 | Humpert et al. |
| 3,998,240 | A | 12/1976 | Liautaud |
| 4,026,328 | A | 5/1977 | Nelson |
| 4,064,900 | A | 12/1977 | Schmitt |
| 4,186,761 | A | 2/1980 | Guarnieri |

(Continued)

FOREIGN PATENT DOCUMENTS

| | | |
|---|---|---|
| CH | 245633 | 11/1947 |

(Continued)

*Primary Examiner*—Charles E. Phillips
(74) *Attorney, Agent, or Firm*—Baker & Daniels LLP

(57) ABSTRACT

A top mounting faucet assembly comprising a mounting plate that may be mounted to a sink surface, a waterway tube, a faucet body housing, and a locking mechanism. The waterway tube is housed within the faucet body housing, to form a removable faucet assembly. The locking mechanism is attached to the mounting plate. This removable faucet assembly is mounted upon the mounting plate by attaching the faucet assembly to the locking mechanism.

14 Claims, 19 Drawing Sheets

U.S. PATENT DOCUMENTS

| | | | |
|---|---|---|---|
| RE30,559 | E | 3/1981 | Schmitt |
| 4,290,445 | A | 9/1981 | Turner |
| 4,328,830 | A | 5/1982 | Greer |
| 4,337,795 | A | 7/1982 | Argyris et al. |
| 4,356,574 | A | 11/1982 | Johnson |
| 4,387,738 | A | 6/1983 | Bisonaya et al. |
| 4,446,885 | A | 5/1984 | Nolden |
| 4,458,839 | A | 7/1984 | MacDonald |
| 4,513,769 | A | 4/1985 | Purcell |
| 4,552,171 | A | 11/1985 | Farrell et al. |
| 4,635,673 | A | 1/1987 | Gerdes |
| 4,649,958 | A | 3/1987 | Purcell |
| 4,671,316 | A | 6/1987 | Botnick |
| 4,678,002 | A | 7/1987 | Valley |
| 4,700,928 | A | 10/1987 | Marty |
| 4,706,702 | A | 11/1987 | Grasseschi |
| 4,760,861 | A | 8/1988 | Botnick |
| 4,762,143 | A | 8/1988 | Botnick |
| 4,762,273 | A | 8/1988 | Gregory et al. |
| 4,771,485 | A | 9/1988 | Traylor |
| 4,827,538 | A | 5/1989 | Heimann et al. |
| 4,848,395 | A | 7/1989 | Krippendorf |
| 4,852,192 | A | 8/1989 | Viegener |
| 4,856,121 | A | 8/1989 | Traylor |
| 4,903,725 | A | 2/1990 | Ko |
| 4,911,335 | A | 3/1990 | Stofle et al. |
| 4,998,555 | A | 3/1991 | Barhydt, Sr. et al. |
| 5,010,922 | A | 4/1991 | Agresta |
| 5,020,569 | A | 6/1991 | Agresta |
| 5,027,851 | A | 7/1991 | Drees et al. |
| 5,073,991 | A | 12/1991 | Marty |
| 5,090,062 | A | 2/1992 | Hochstrasser |
| 5,095,554 | A | 3/1992 | Gloor |
| 5,127,427 | A | 7/1992 | Kajpust et al. |
| 5,127,438 | A | 7/1992 | Williams |
| 5,131,428 | A | 7/1992 | Bory |
| 5,148,832 | A | 9/1992 | Lin |
| 5,165,121 | A | 11/1992 | McTargett et al. |
| 5,232,008 | A | 8/1993 | Jeffress et al. |
| 5,275,199 | A | 1/1994 | Howell |
| 5,349,987 | A | 9/1994 | Shieh |
| 5,361,431 | A | 11/1994 | Freier et al. |
| 5,375,272 | A | 12/1994 | Mikol |
| 5,388,287 | A | 2/1995 | Tischler et al. |
| 5,465,749 | A | 11/1995 | Sauter et al. |
| 5,467,799 | A | 11/1995 | Buccicone et al. |
| 5,518,016 | A | 5/1996 | Sharwark |
| 5,535,776 | A | 7/1996 | Kingman |
| 5,558,128 | A | 9/1996 | Pawelzik et al. |
| 5,566,707 | A | 10/1996 | Ching et al. |
| 5,642,755 | A | 7/1997 | Mark et al. |
| 5,660,203 | A | 8/1997 | Gnauert et al. |
| 5,669,417 | A | 9/1997 | Lain-Jie |
| 5,685,341 | A | 11/1997 | Chrysler et al. |
| 5,687,952 | A | 11/1997 | Arnold et al. |
| 5,725,008 | A | 3/1998 | Johnson |
| 5,746,244 | A | 5/1998 | Woolley, Sr. et al. |
| 5,758,688 | A | 6/1998 | Hamanaka et al. |
| 5,797,151 | A | 8/1998 | Ko |
| 5,803,120 | A | 9/1998 | Bertoli |
| 5,813,431 | A | 9/1998 | Cool et al. |
| 5,822,811 | A | 10/1998 | Ko |
| 5,845,345 | A | 12/1998 | Ko |
| 5,865,211 | A | 2/1999 | Thomas |
| 5,865,473 | A | 2/1999 | Semchuck et al. |
| 5,884,662 | A | 3/1999 | Ko |
| 5,894,613 | A | 4/1999 | Fenn |
| 5,918,855 | A | 7/1999 | Hamanaka et al. |
| 5,924,451 | A | 7/1999 | Kuo |
| 5,946,746 | A | 9/1999 | Bloom |
| 5,950,663 | A | 9/1999 | Bloomfield |
| 5,960,490 | A | 10/1999 | Pitsch |
| 5,979,489 | A | 11/1999 | Pitsch |
| 5,983,917 | A | 11/1999 | Thomas |
| 6,023,796 | A | 2/2000 | Pitsch |
| 6,062,251 | A | 5/2000 | Pitsch |
| 6,073,972 | A | 6/2000 | Rivera |
| 6,082,407 | A | 7/2000 | Paterson et al. |
| 6,085,784 | A | 7/2000 | Bloom et al. |
| 6,123,106 | A | 9/2000 | Benstead |
| 6,138,296 | A | 10/2000 | Baker |
| 6,161,230 | A | 12/2000 | Pitsch |
| 6,170,098 | B1 | 1/2001 | Pitsch |
| 6,189,569 | B1 | 2/2001 | Calhoun |
| 6,195,818 | B1 | 3/2001 | Rodstein et al. |
| 6,202,686 | B1 | 3/2001 | Pitsch et al. |
| 6,202,980 | B1 | 3/2001 | Vincent et al. |
| 6,209,153 | B1 | 4/2001 | Segien, Jr. |
| 6,220,278 | B1 | 4/2001 | Sauter et al. |
| 6,220,279 | B1 | 4/2001 | Segien |
| 6,256,810 | B1 | 7/2001 | Baker |
| 6,267,136 | B1 | 7/2001 | Johnson |
| 6,273,138 | B1 | 8/2001 | Yoney |
| 6,273,394 | B1 | 8/2001 | Vincent et al. |
| 6,301,728 | B1 | 10/2001 | Pilatowicz et al. |
| 6,302,131 | B1 | 10/2001 | Pitsch |
| 6,314,593 | B1 | 11/2001 | Mantel |
| 6,328,059 | B1 | 12/2001 | Testori et al. |
| 6,334,226 | B1 | 1/2002 | Tokunaga et al. |
| 6,360,770 | B1 | 3/2002 | Buchner et al. |
| 6,360,774 | B1 | 3/2002 | Becker et al. |
| 6,370,712 | B1 | 4/2002 | Burns et al. |
| 6,378,912 | B1 | 4/2002 | Condon et al. |
| 6,385,798 | B1 | 5/2002 | Burns et al. |
| 6,405,749 | B1 | 6/2002 | Bloom et al. |
| 6,422,520 | B1 | 7/2002 | Hand |
| 6,434,765 | B1 | 8/2002 | Burns et al. |
| 6,438,771 | B1 | 8/2002 | Donath, Jr. et al. |
| 6,757,921 | B2 | 7/2004 | Esche |
| 6,807,692 | B2 | 10/2004 | Tsutsui et al. |
| 6,868,564 | B2 | 3/2005 | Ginter et al. |
| 6,874,527 | B2 | 4/2005 | Meeder |
| 6,912,742 | B1 | 7/2005 | Wang |
| 6,918,400 | B2 | 7/2005 | Buchner et al. |
| 2001/0011389 | A1 | 8/2001 | Philipps-Liebich et al. |
| 2001/0044955 | A1 | 11/2001 | Brandebusemeyer |
| 2002/0083520 | A1 | 7/2002 | Kirby-Osborne |
| 2004/0123910 | A1 | 7/2004 | Yardley |
| 2004/0143900 | A1 | 7/2004 | Nelson et al. |
| 2004/0179351 | A1 | 9/2004 | Patterson |
| 2004/0200987 | A1 | 10/2004 | Houghton |
| 2004/0221899 | A1 | 11/2004 | Parsons et al. |
| 2005/0022299 | A1 | 2/2005 | Brown et al. |
| 2005/0199843 | A1 | 9/2005 | Jost et al. |
| 2005/0242198 | A1 | 11/2005 | Kempf et al. |
| 2005/0242199 | A1 | 11/2005 | Kempf et al. |
| 2005/0251907 | A1 | 11/2005 | Mintz et al. |

FOREIGN PATENT DOCUMENTS

| | | |
|---|---|---|
| CH | 275914 | 6/1951 |
| CN | 1278584 | 1/2001 |
| CN | 1278585 | 1/2001 |
| CN | 1278586 | 1/2001 |
| CN | 1278588 | 1/2001 |
| DE | 100 22 350 A1 | 11/2001 |
| EP | 0808952 B1 | 9/2003 |
| GB | 371616 | 5/1931 |
| WO | WO 2005/056937 | 6/2005 |
| WO | WO 2005/118966 | 12/2005 |

TOP DOWN MOUNTING SYSTEM FOR A FAUCET

CROSS REFERENCE TO RELATED APPLICATIONS

This application is a divisional of U.S. patent application Ser. No. 10/411,432, filed Apr. 10, 2003 now U.S. Pat. No. 7,003,818, which claims the benefit of U.S. Provisional Application No. 60/373,277, filed Apr. 17, 2002, the disclosures of which are expressly incorporated by reference herein.

BACKGROUND AND SUMMARY OF THE INVENTION

The present invention relates to a top mounting system for faucets in which the faucet may be mounted from the top of the countertop or sink.

The installation of a faucet onto a countertop or sink is a difficult and time-consuming task. At least some of the installation must be done with the installer being in the confined and hard to work in area under the counter or sink. There is a need to provide a less cumbersome and complicated system of installing faucets or interchanging different faucet styles, such as single handle faucets and two handle faucets, onto a countertop or sink which can be done largely from the top of the countertop or sink. The present invention provides such a system.

The instant invention relates to a faucet containing a valve assembly for mounting on a sink ledge from above or the top of the sink ledge. The top mounting system includes a mounting plate for mounting on the top of the sink ledge containing means for attaching a faucet body housing to the mounting plate. The mounting plate has two vertical downwardly extending support rods which extend through access openings in the sink ledge and on which are mounted vertically movable clamping arms which are adapted to abut against the underside of the sink ledge, thereby clamping the mounting plate to the sink ledge. Rotation of the support rods, which are preferably threaded, effects movement of the clamping arms toward the underside of the sink ledge.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
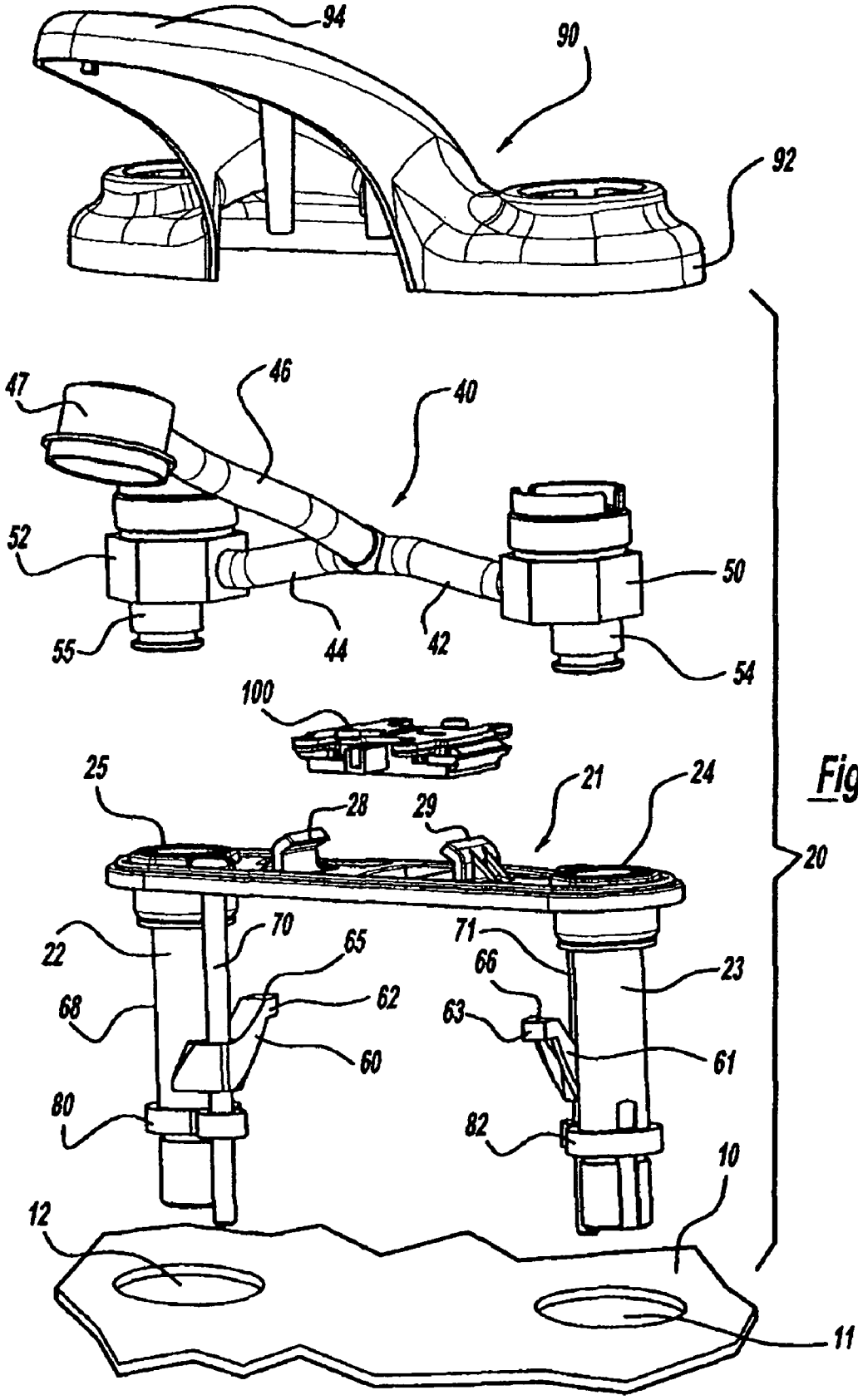
FIG. 1 is an exploded perspective view of the top mounting faucet assembly on a countertop or sink ledge.
Figure 2:
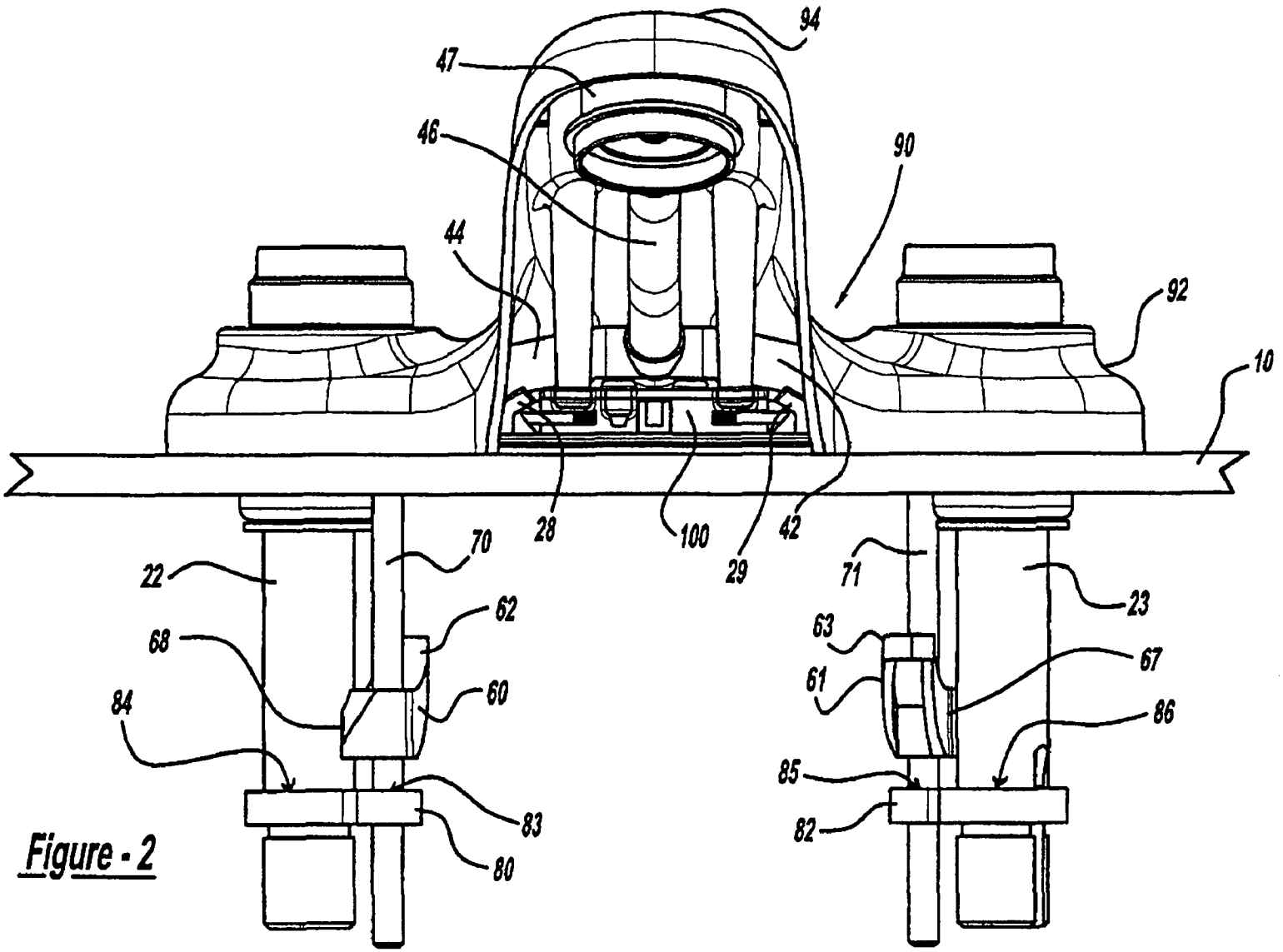
FIG. 2 is a front elevational view of the top mounting faucet assembly mounted on a sink ledge with the locking members in the down or unlocked position.
Figure 3:
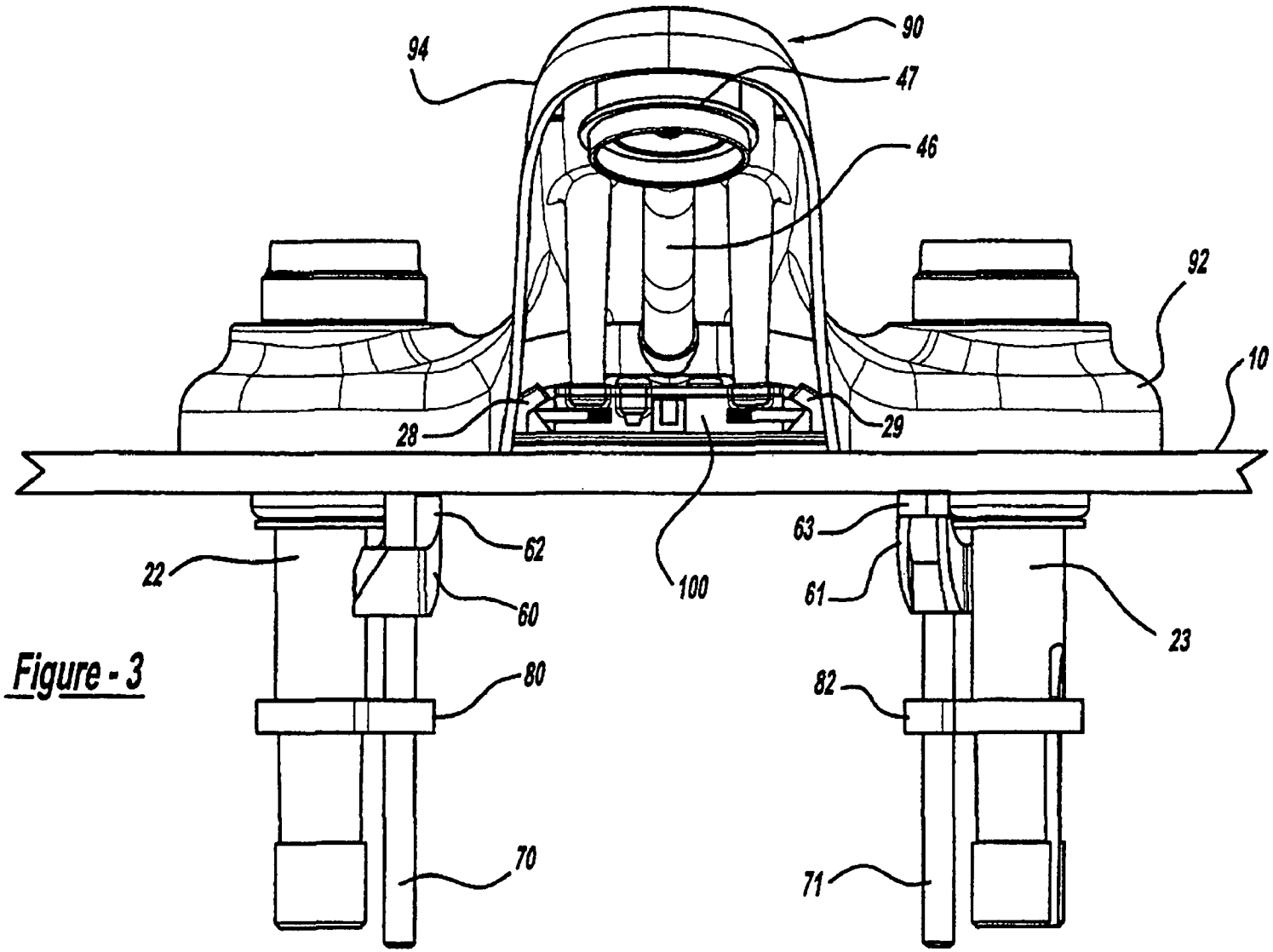
FIG. 3 is a view similar to FIG. 2 except that the locking members are in the up or locked position.

Referring to FIGS. 1–3, a top mounting faucet assembly 20 is shown in conjunction with a countertop or sink ledge 10, having access openings 11, 12 on which it is mounted. The top mounting faucet assembly includes a mounting base, illustratively a mounting plate 21, a tube waterway 40, a faucet body housing 90 with a base 92 and a spout 94, and a locking mechanism 100. An undercover plate (not shown) is connected to cover the underside of the spout 94 and the waterway 40.

In the embodiment illustrated in FIGS. 1 and 2 for a two-handle faucet, the waterway 40 is generally "T" shaped with two arms 42, 44 and a spout leg 46 extending from the arms 42, 44 to form a "T" shape. At the free end of the spout leg 46 is a discharge head 47 in which is disposed an aerator (not shown). The two arms 42, 44 of the waterway 40 are connected to valves 50, 52 that deliver water to the waterway 40. The waterway 40, including the arms 42, 44 and the spout leg 46 are disposed within the faucet body housing 90 as best shown in FIGS. 2 and 3.

The mounting plate 21 is mounted from the top of the sink or countertop 10, and sits on top of the countertop 10. It should be noted that the mounting plate 21 might also be mounted from the underside of the countertop 10. Extending downwardly from mounting plate 21 are two inlet water conduits 22, 23. Inlet water conduits pass through access openings 11, 12 in the countertop 10, and are connected to water supply tubes (not shown) under the countertop 10 or sink. Inlet water conduits 22, 23 receive, at their top ends 24, 25 tubes 54, 55 of waterway 40 which extend downwardly from valves 50, 52. Tubes 54, 55 carry hot and cold water from inlet water conduits 22, 23 to valves 50, 52.

To mount the faucet assembly 20 onto the countertop 10 water inlet conduits 22, 23, mounting plate locking members 60, 61, threaded members 70, 71, and securing members 80 and 82 of threaded members 70, 71, are inserted through the access openings 11, 12, and the mounting plate 21 is lowered until it rests on the countertop 10.

The mounting plate 21 locking members 60, 61 are vertically movably mounted on threaded members 70, 71 that are disposed coaxial with and adjacent to water conduits 22, 23, respectively.

Figure 4:
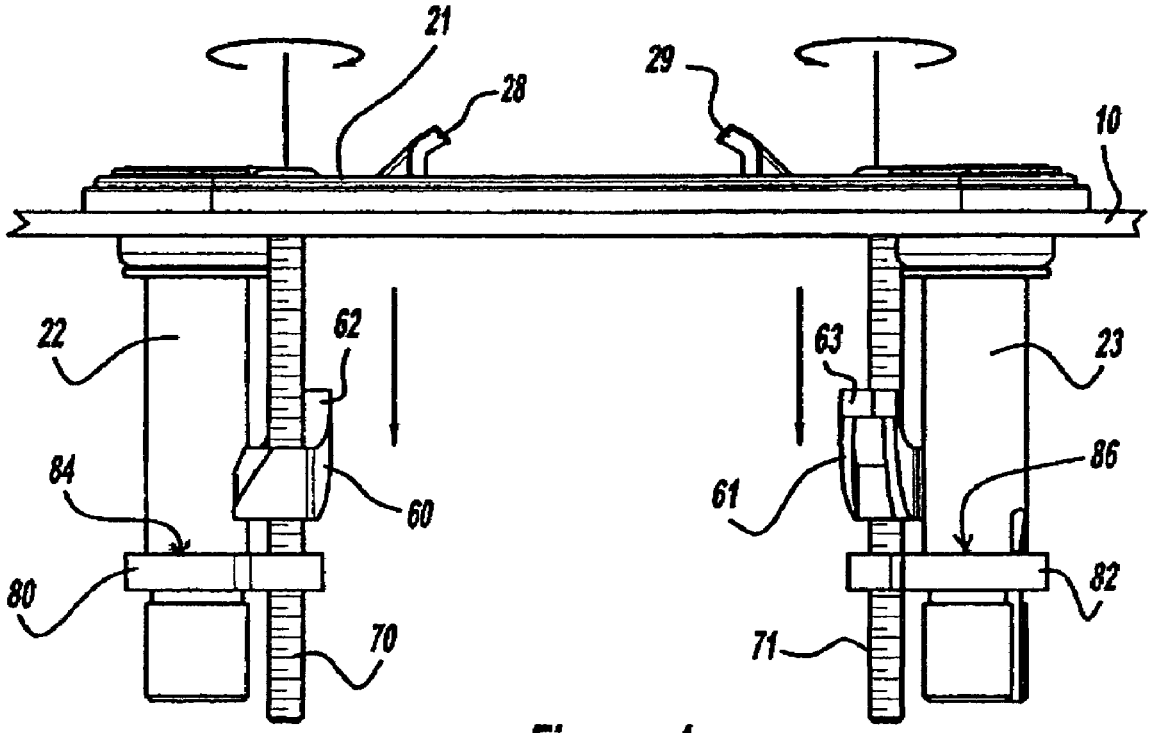
FIG. 4 is a front elevational view of the mounting plate with the locking members in a down or unlocked position.
Figure 8:
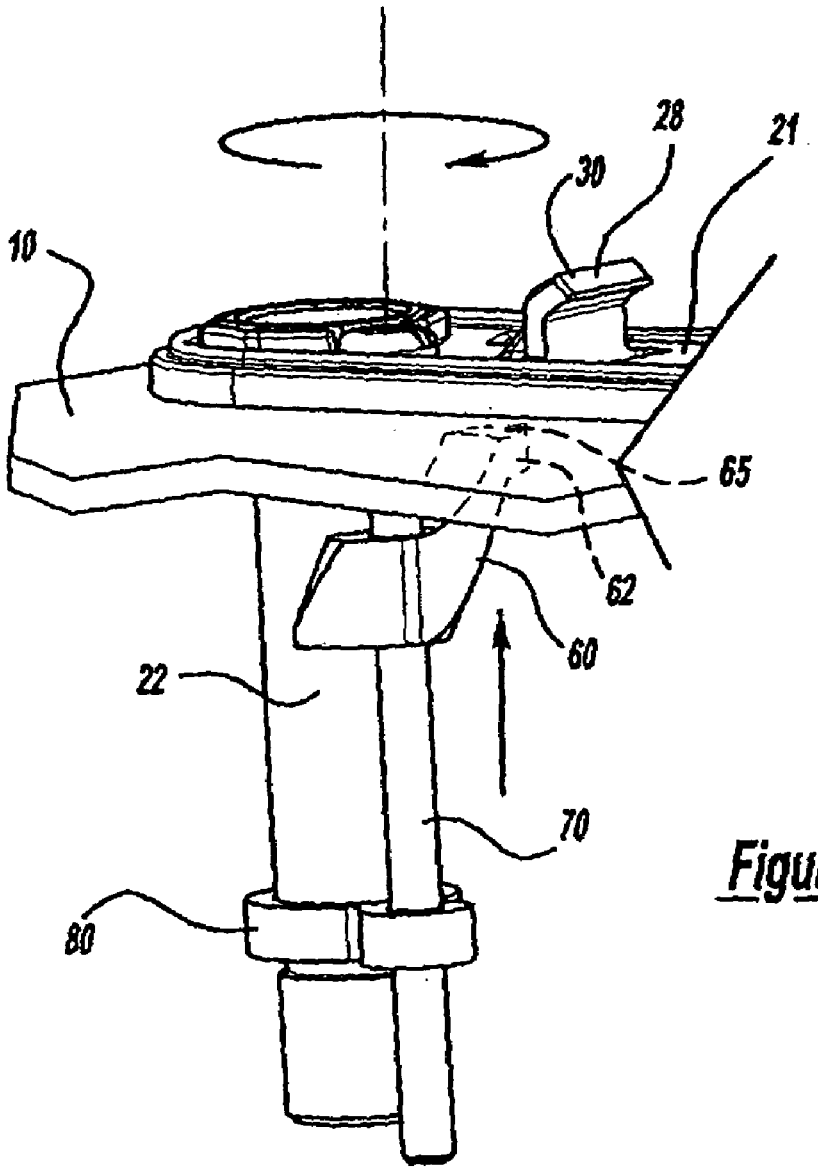
FIG. 8 is a view similar to FIG. 7 except that the locking member is in an up or locked position.
Figure 9:
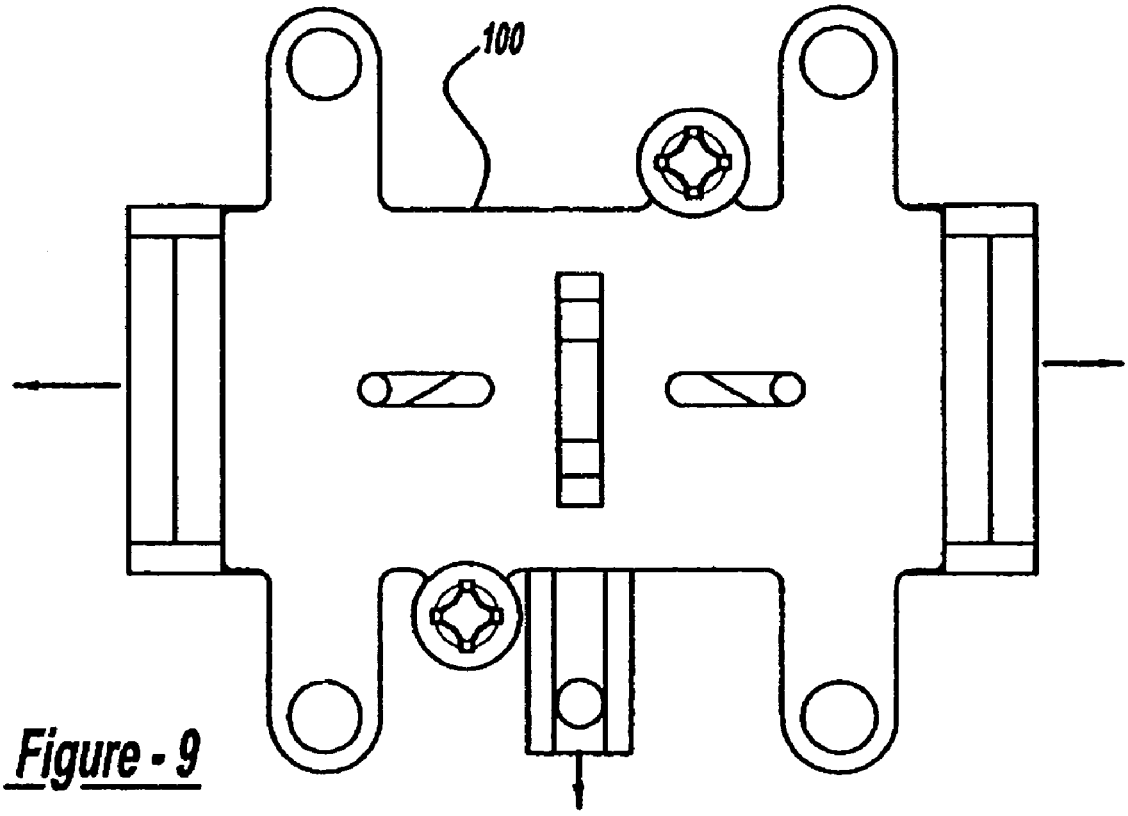
FIG. 9 is a top plan view of a locking mechanism that secures the mounting plate to the faucet body housing.
Figure 10:
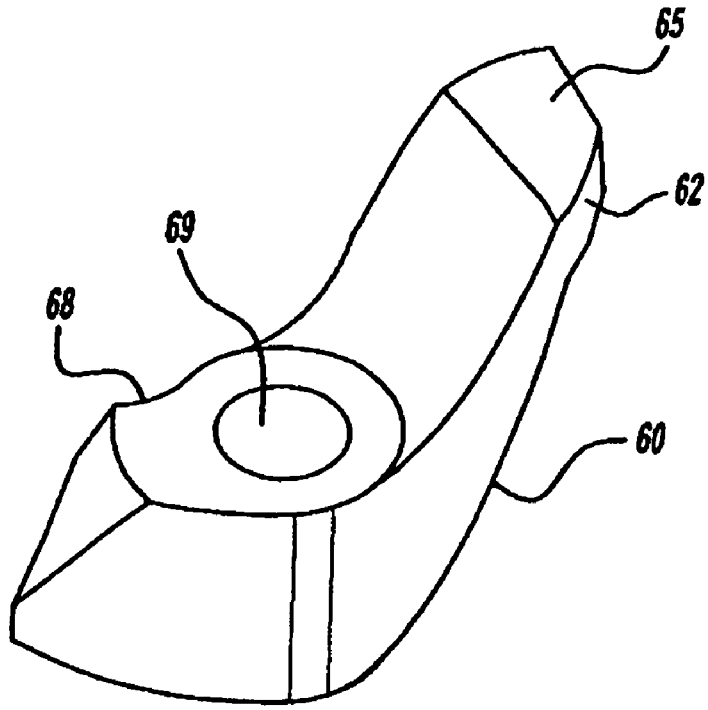
FIG. 10 is a perspective view of a locking member.

When the mounting plate 21 is on the countertop 10, the threaded members 70, 71 are rotated to cause the mounting plate locking members 60, 61 to move up or down on the threaded members 70, 71. As best illustrated in FIG. 4 counterclockwise rotation of threaded members 70, 71 causes locking members 60, 61 to move downwardly or away from countertop 10 to an unlocked position. A clockwise rotation of threaded members 70, 71, as seen in FIG. 8, causes locking members 60, 61 to move upwardly or toward countertop 10 to a locked position.

In the locked position the tops 66, 65 of fingers 62, 63 of locking members 60, 61 abut the bottom or underside of countertop 10, thereby securing mounting plate 21 to countertop 10.

The locking members 60, 61 are prevented from rotating with the threaded members 70, 71 as they are turned, by guide surfaces 67, 68 of the locking members 60, 61. Guide surfaces 67, 68 abut against water inlet conduits upon rotation of the locking members. This causes locking members 60, 61 to ride up or down threaded members 70, 71 as these threaded members are rotated instead of rotating 360 degrees with the rotation of the threaded members 70, 71.

Threaded members 70, 71 are stabilized and secured at their bottom portions by securing members 80, 82. The threaded members 70, 71 extend through apertures 83, 85 in securing members 80, 82. Securing members 80, 82 are mounted on water inlet conduits 22, 23 via apertures 84, 86 into which water conduits 22, 23 are inserted.

To remove the top mounting faucet assembly 20 from the countertop or sink ledge 10, threaded members 70, 71 are turned in a counter-clockwise manner, as illustrated in FIG. 4, moving the locking members 60, 61 downwardly away from the underside of the sink ledge 10. The water inlet conduits 22, 23, mounting plate locking members 60, 61, threaded members 70, 71, and threaded members securing or stabilizing members 80, 82 of mounting plate 21 are then pulled up through the access openings 11, 12 in the sink ledge 10.

Figure 5:
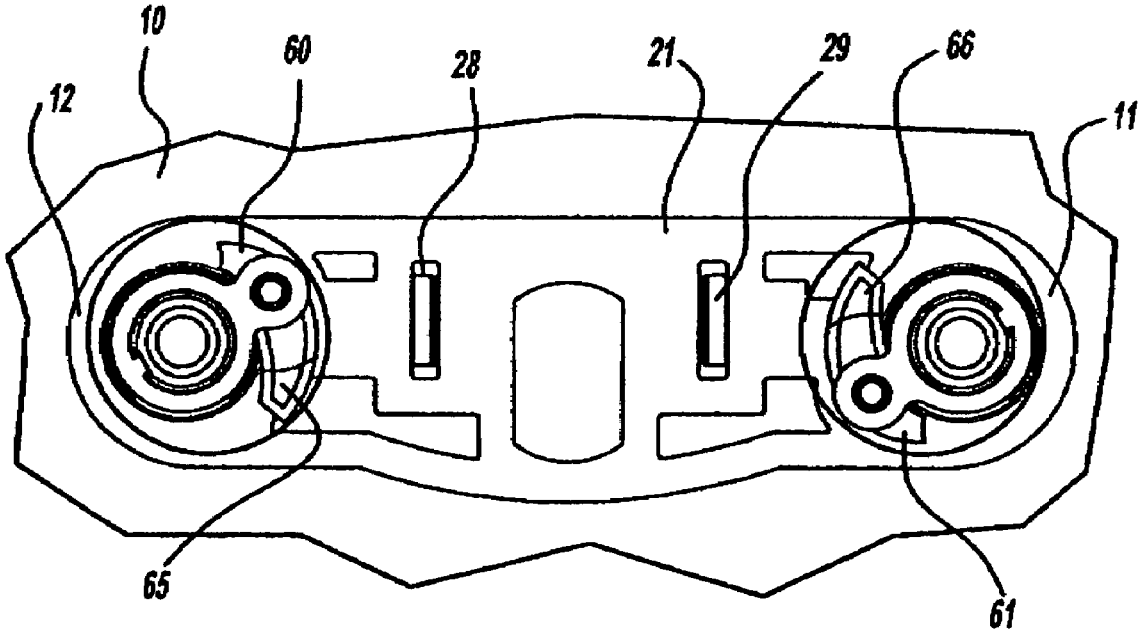
FIG. 5 is a top plan view of the mounting plate on a sink ledge with the locking members in a down or unlocked position.

As best seen in FIG. 5 in the unlocked or down position fingers 62, 63 of locking members 60, 61 are swiveled against the inlet water conduits 22, 23, and can be pulled out through access openings.

Figure 11:
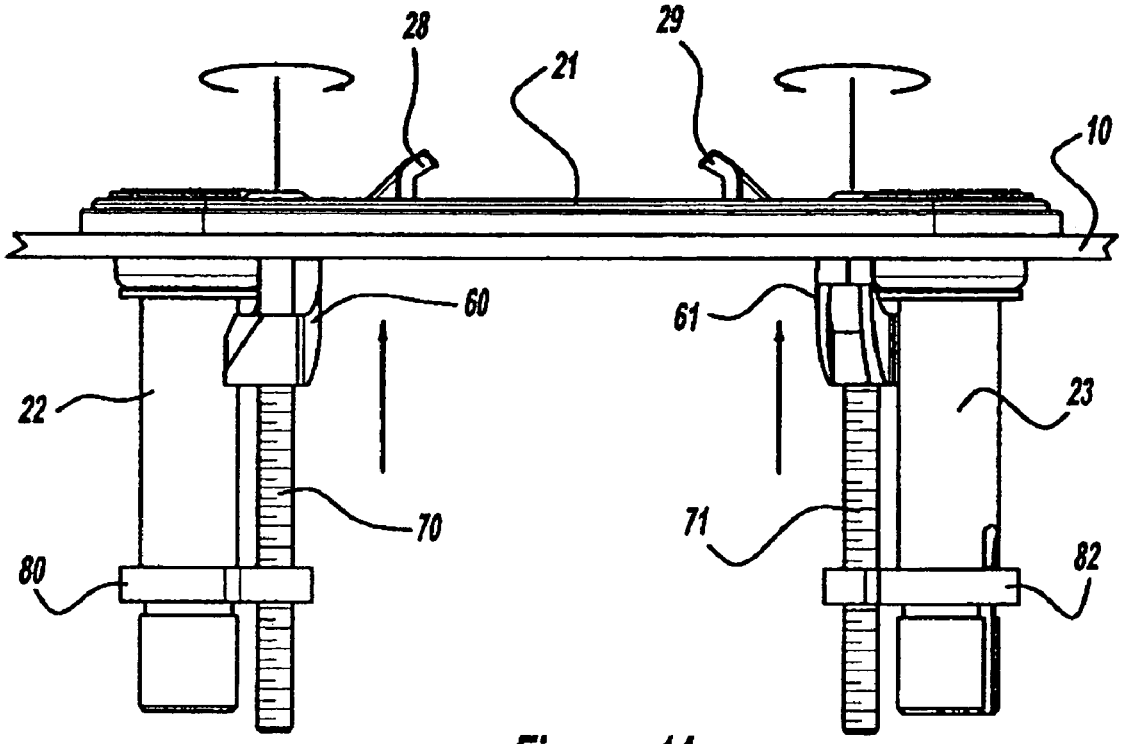
FIG. 11 is a front elevational view of the mounting plate on a sink ledge with the locking members in an up or locked position.
Figure 12:
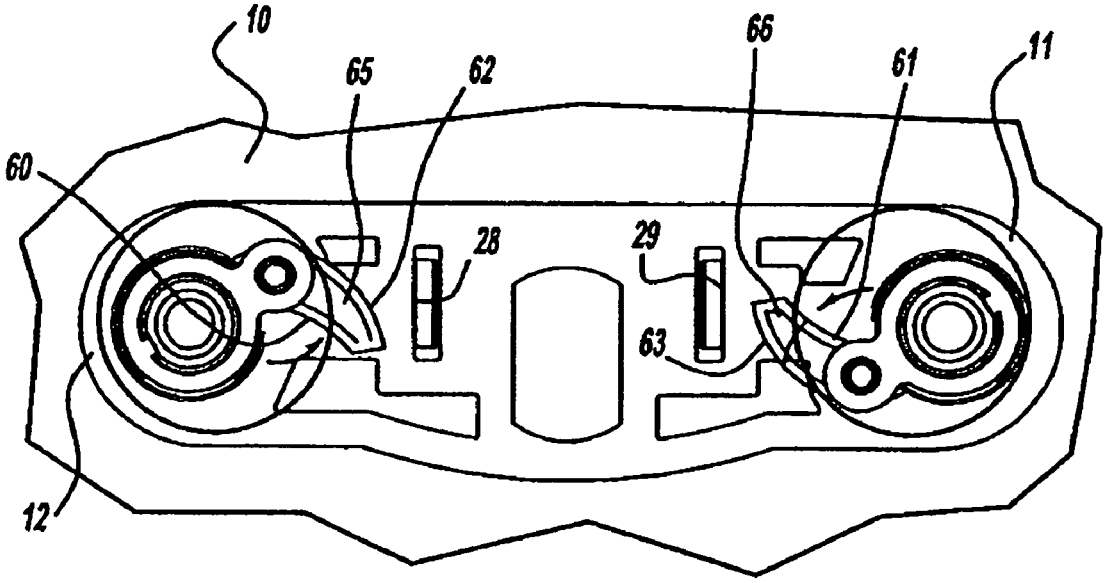
FIG. 12 is a top plan view of the mounting plate on a sink ledge with the locking members in an up or locked position.

As seen in FIGS. 11 and 12, in the up or locked position fingers 62, 63 of locking members 60, 61 are swiveled away from inlet water conduits 22, 23 and their tops 66, 65 abut against the bottom or underside of countertop 10. In this position the fingers 62, 63 cannot be pulled through access openings 11, 12.

It is also possible that the water inlet conduits 22 and 23 may be threaded on the outer surface itself. This would then allow the mounting plate 21 to be installed in the conventional under-the-sink fashion using compatible nuts. Other known methods for under-the-sink attaching of the mounting plate 21 are envisioned as part of this invention.

Figure 13:
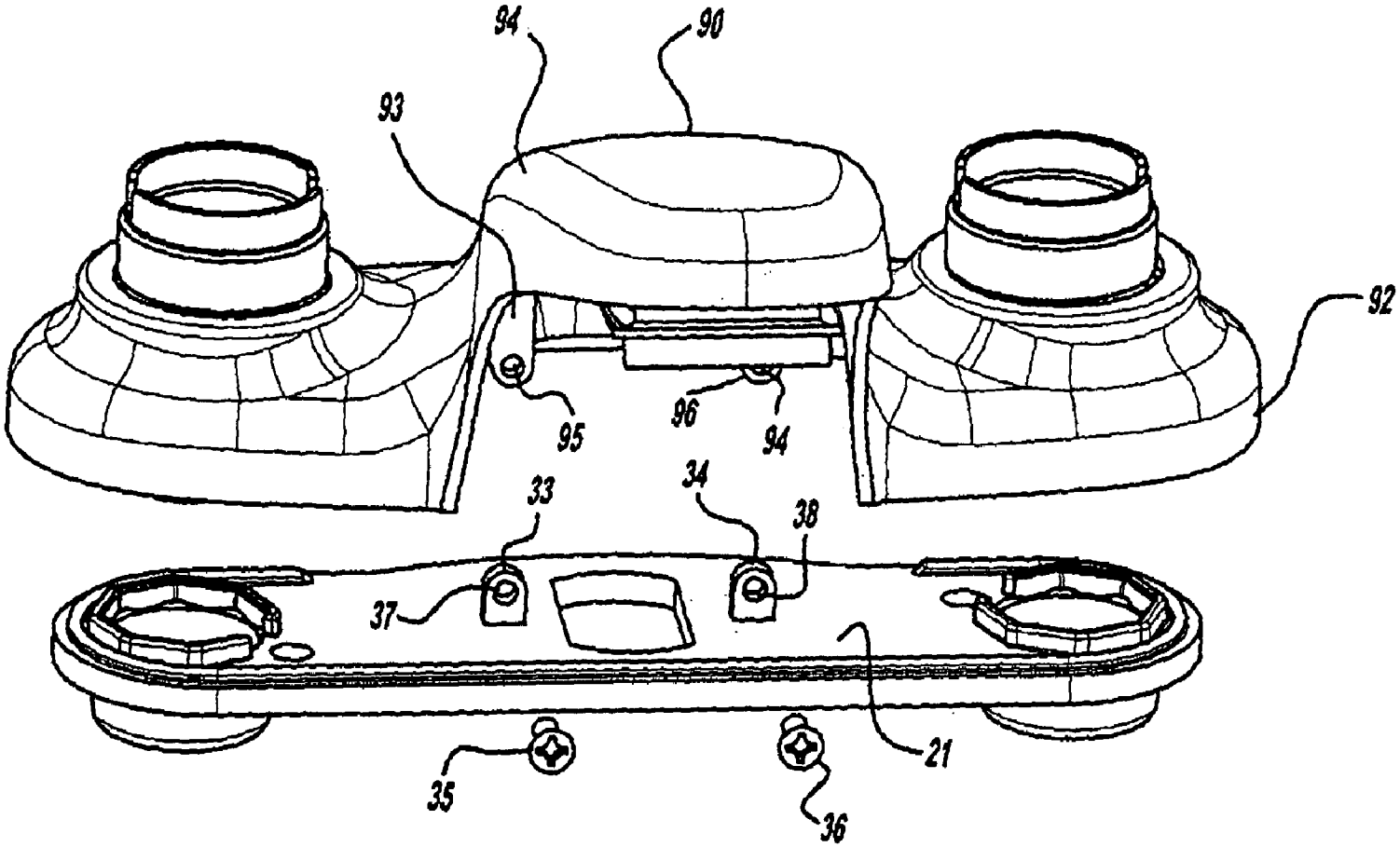
FIG. 13 illustrates an alternate embodiment for connecting the faucet body housing to the mounting plate, specifically by fastening means such as screws.

In one embodiment, as illustrated in FIG. 13, the faucet body housing 90 is attached to mounting plate 21 by fastening members 35, 36 such as screws or bolts which pass through aligned openings 95, 96, 37, 38 in raised ears 33, 34, 93, 94.

In another embodiment the faucet housing 90 is attached to mounting plate 21 by a locking mechanism 100. The locking mechanism 100 is mounted on the mounting plate 21 by means of two spaced apart securing members 28, 29 extending upwardly from the mounting plate 21.

Figure 6:
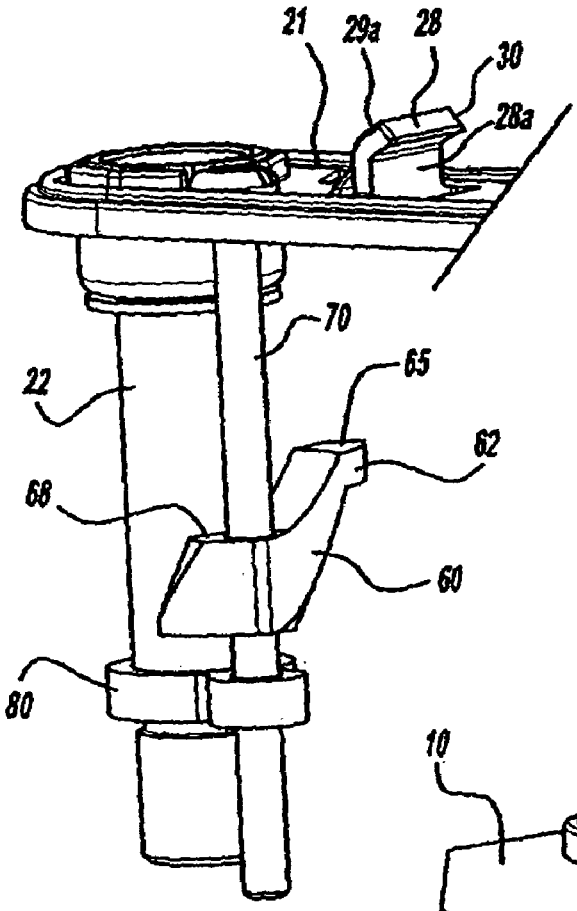
FIG. 6 is a partial view of the mounting plate with the locking members in a down or unlocked position.
Figure 7:
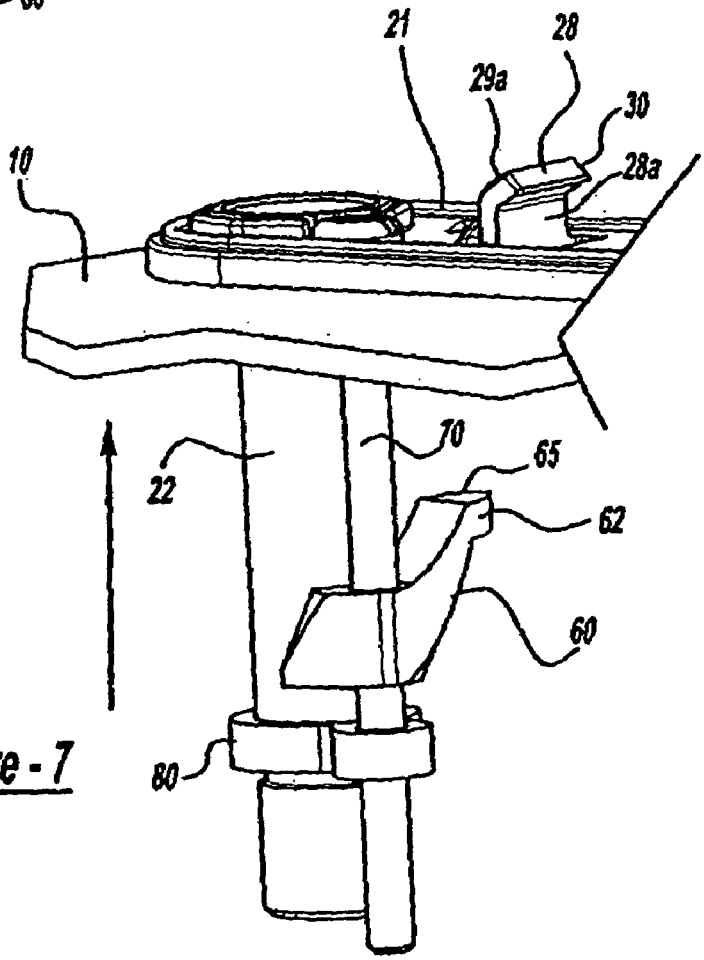
FIG. 7 is a view similar to FIG. 6 except that the mounting plate is disposed on a sink ledge.

As shown in FIGS. 6–8, the attachment means or securing members 28, 29 of mounting plate 21 comprise an upwardly extending tab portion having a vertical body portion 28*a* and an inwardly angled arm 29*a*. The inwardly angled arm 29*a* has a sloping leading ledge 30.

Figure 14:
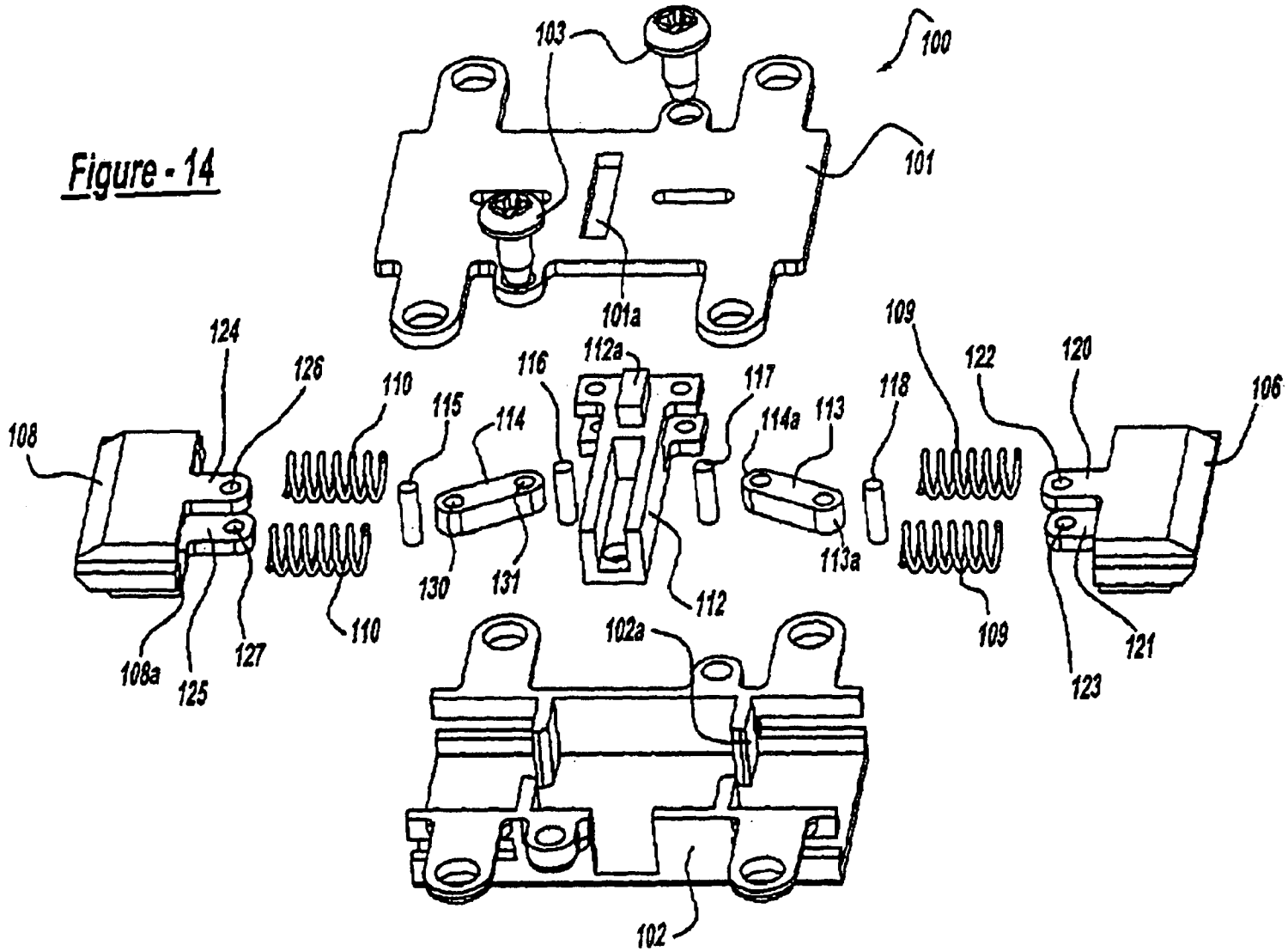
FIG. 14 is an exploded perspective view of a locking mechanism utilized to secure the faucet body housing to the mounting plate.
Figure 17:
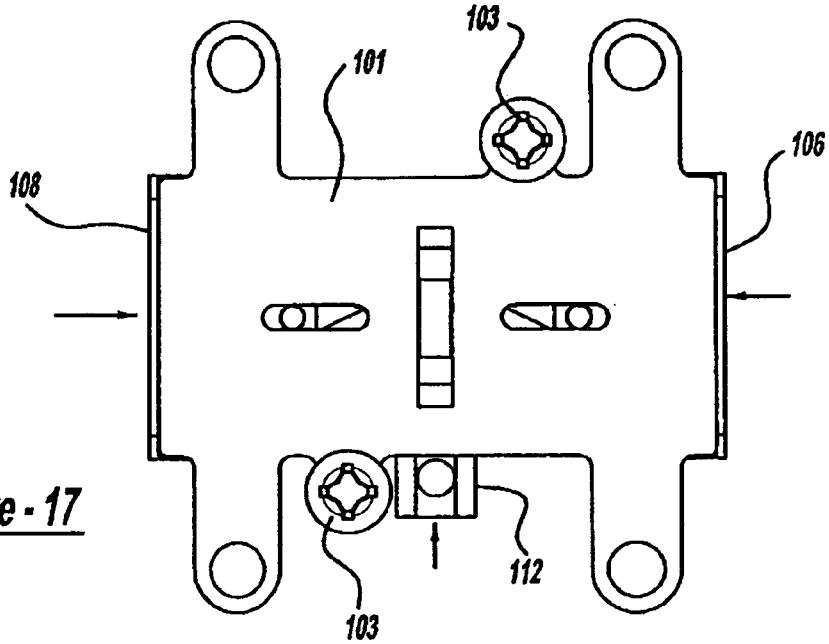
FIG. 17 is a view similar to FIG. 16 except that the locking arms are in a retracted position.
Figure 18:
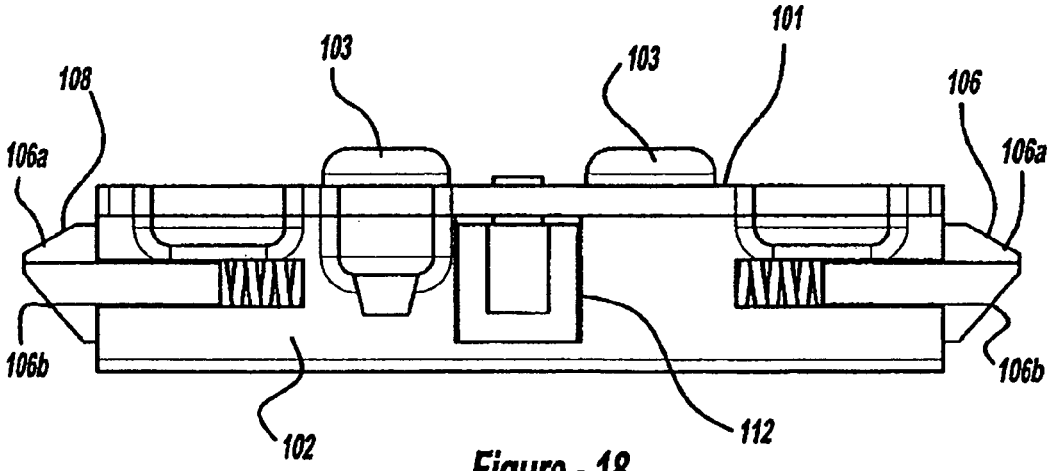
FIG. 18 is a front elevational view of the locking mechanism with the locking arms in an extended position.
Figure 19:
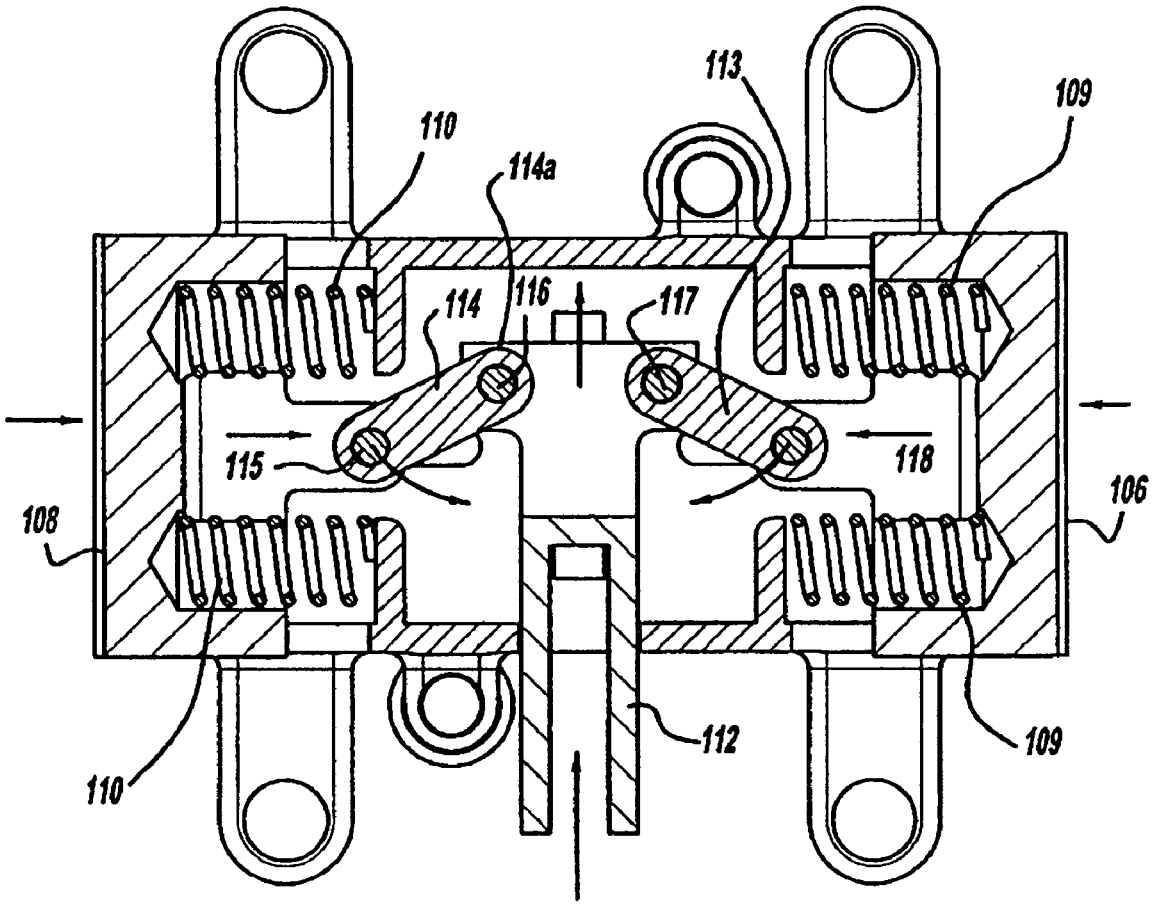
FIG. 19 is a sectional top plan view of the locking mechanism with the locking arms in a retracted position.
Figure 20:
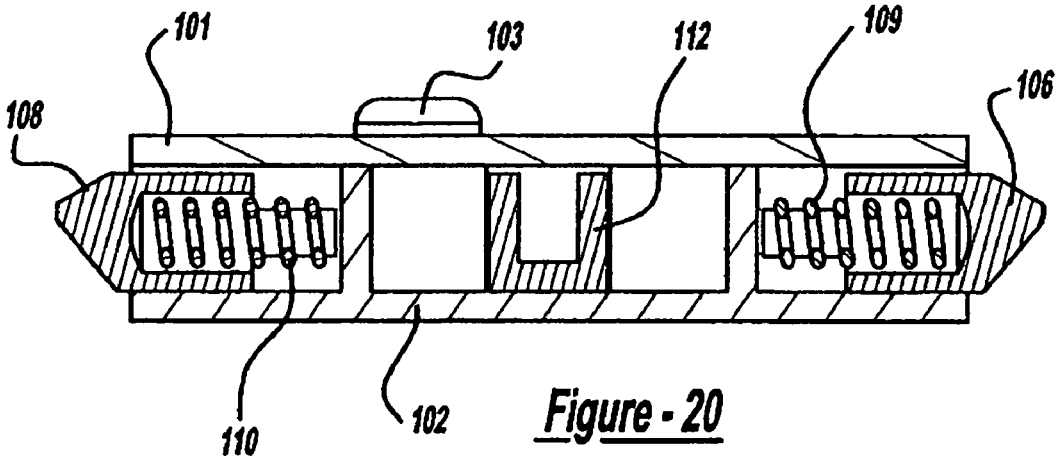
FIG. 20 is a front elevational view, in section, of the locking mechanism with the locking arms in an extended position.

In one embodiment, as illustrated in FIGS. 14–21, the locking mechanism 100 is comprised of a top cover 101 and a bottom cover 102. Two spring-loaded locking arms 106, 108 are located in the locking mechanism and movably extend out the two opposite open sides of the locking mechanism 100. As shown in FIGS. 14 and 19, the locking mechanism 100 further comprises biasing members, illustratively spring pairs 109 and 110 that have one end located within openings 108*a* in the locking arms 106 and 108, and the other end resting against an inner wall 102*a* of the bottom cover 102. Also shown in FIG. 14, are linkages 113 and 114, having an outer end 113*a* and an inner end 114*a*. The outer ends 113*a* of linkages 113 and 114 are attached by pins 115, 118 to the locking arms 106 and 108. The inner ends 114*a* of the linkages 113 and 114 are similarly attached to an operating rod 112 via pins 116 and 117. The operating rod has a stop 112*a* on its upper surface that rides within a guide slot 101*a* within the top cover 101 of the locking mechanism 100.

Figure 15:
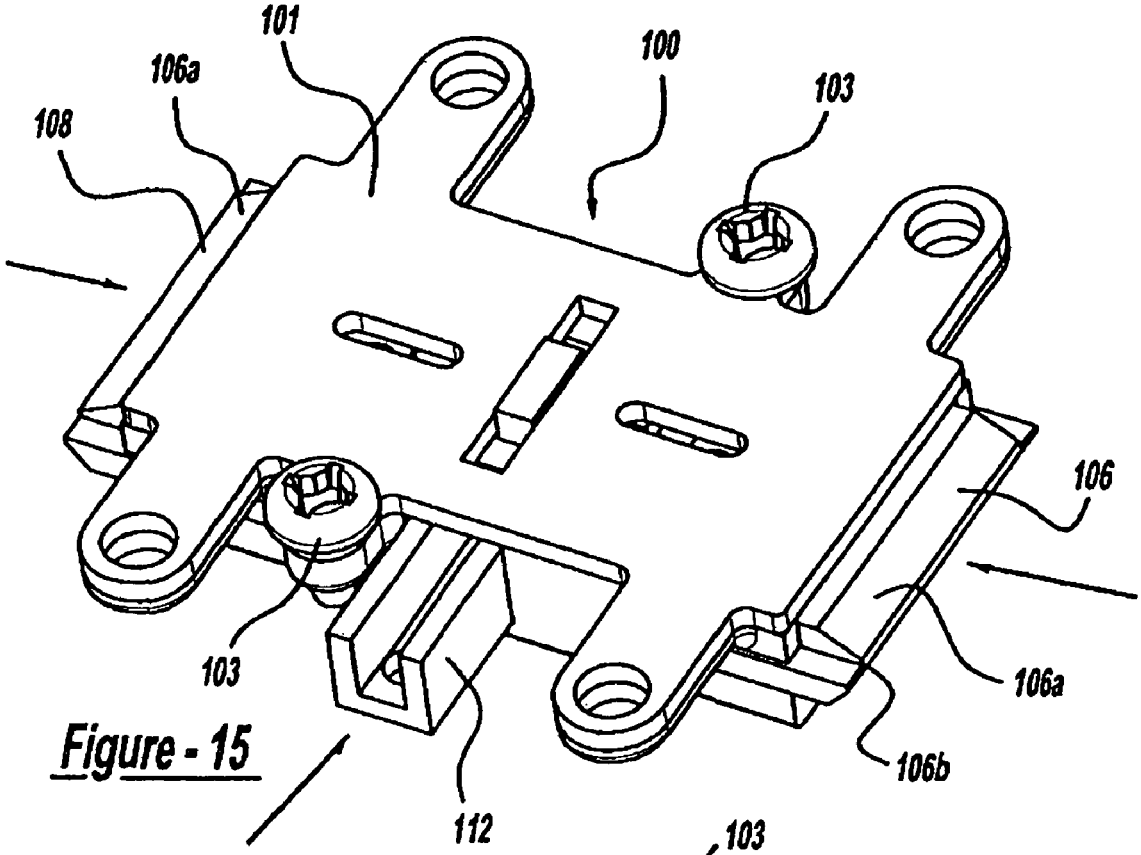
FIG. 15 is a perspective view of a locking mechanism utilized to secure the faucet body housing to the mounting plate with the locking arms extended or in the out position.
Figure 16:
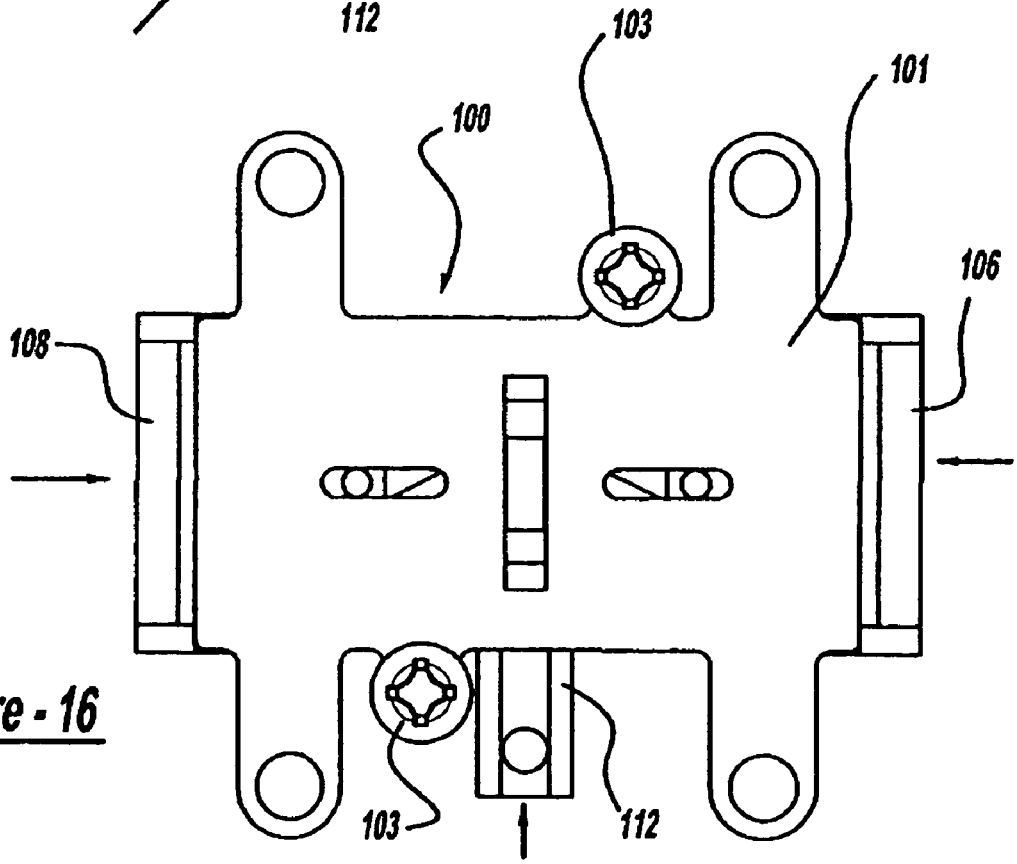
FIG. 16 is a top plan view of the locking mechanism of FIG. 15 with the locking arms extended.

When these locking arms 106, 108 are extended they engage securing members 28, 29 on the mounting plate 21. The locking arms 106, 108, being spring loaded, are normally in an extended position, as shown in FIGS. 15, 16 and 18. The spring loaded locking arms 106 and 108 have angled top surfaces 106*a* and bottom surfaces 106*b*. Once the mounting plate 21 is installed on top of the sink ledge or countertop 10, the locking mechanism 100 may be installed onto the mounting plate 21 by simply aligning the faucet body housing 90 over the mounting plate 21 and pressing the faucet body housing into place. As the locking mechanism 100 is pressed into position, the bottom sloping surfaces 106*b* abut the sloping leading ledge 30 of the mounting plate 21. This bottom sloping surface 106*b* assists the locking arms 106, 108 to retract into the locking mechanism 100. Once inserted, the locking arms 106, 108 spring back to their original extended position, thereby locking the faucet body housing 90 into position onto the mounting plate 21. After the locking arms 106, 108 are in place, the installer can then pull out or extend the operating rod 112, which, as shown in FIG. 19, drives the inner ends 114*a* of linkages 113, 114 downwards, further forcing locking arms 106, 108 outwards against the angled arm 29*a* of attachment means 28, 29. Once the linkages 113, 114 pass through horizontal, corresponding to when the stop 112*a* reaches the limit of guide slot 101*a*. This locks the locking arms 106, 108 in the fully locked position.

Figure 21:
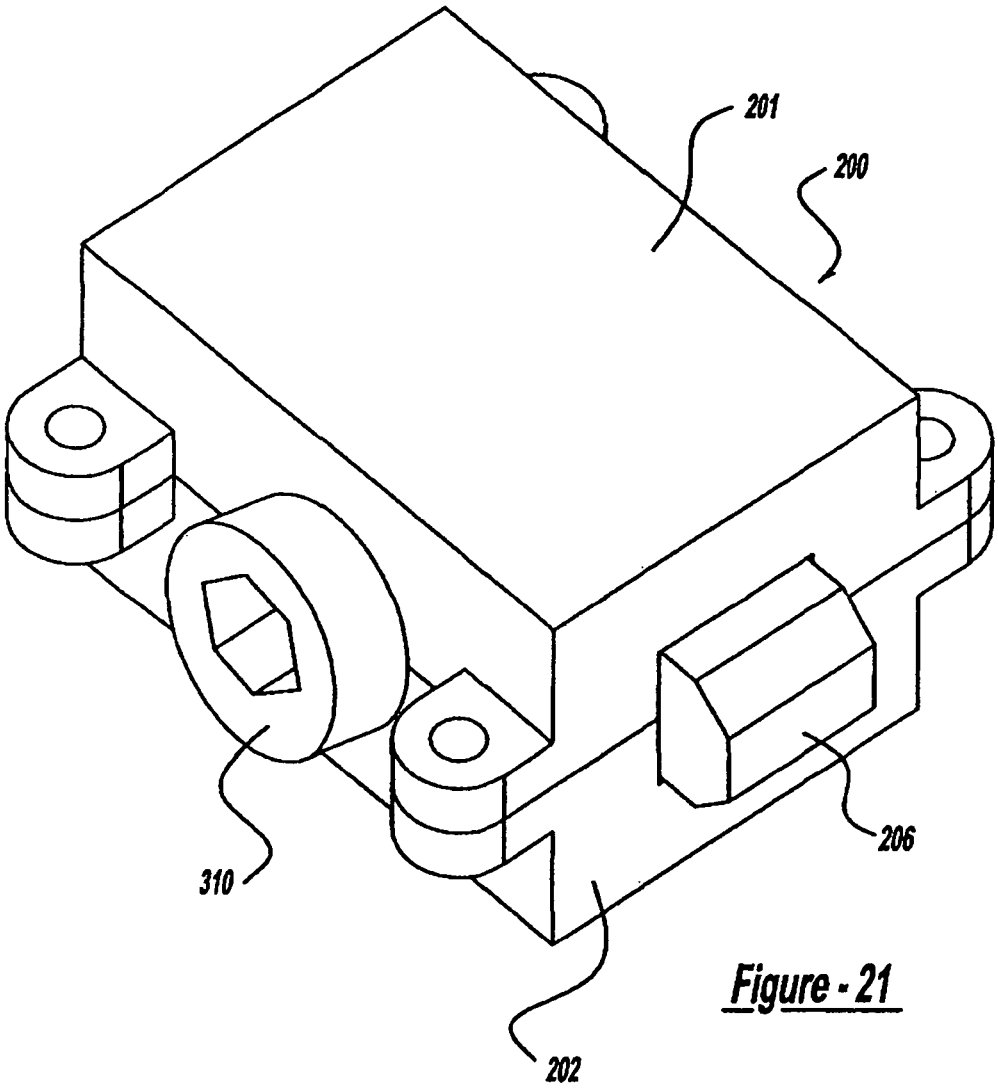
FIG. 21 is a perspective view of a second embodiment of a locking mechanism that secures the faucet body housing to the mounting plate with the locking arms in the extended position.

To retract the locking arms to a retracted position, as shown in FIGS. 17 and 21, so that the faucet body housing 90 can be removed from the mounting plate 21, an operating rod 112 is pushed inwardly into the locking mechanism 100 as shown by the arrow in FIG. 17. This, as shown in FIG. 19, causes linkage 113, 114, to swivel, which results in inward retraction of locking arms 106, 108 against the opening forces caused via springs 109 and 110. Upon release of inward force upon operating rod 112 springs 109, 110 force locking arms 106, 108 out of the sides of locking mechanism 100 and to their extended locking positions.

Figure 22:
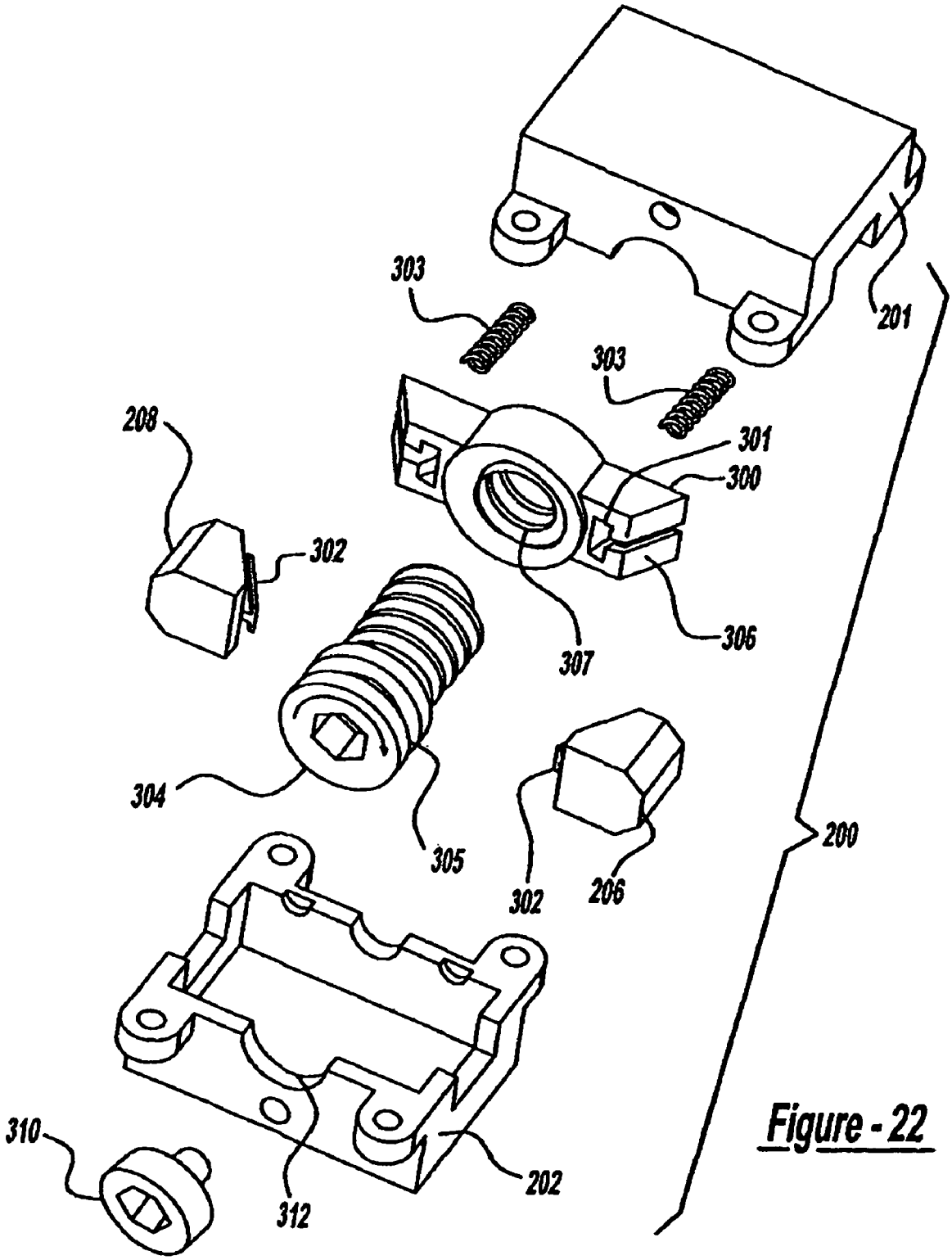
FIG. 22 is an exploded perspective view of the second embodiment of the locking mechanism utilized to secure the faucet body housing to the mounting plate.

In a second embodiment a different locking mechanism 200 as illustrated in FIGS. 21 and 22 can be used in place of locking mechanism 100. This locking mechanism 200 also has two locking arms 206, 208 extending from its sides. Just as with locking mechanism 100, the locking arms 206, 208 are normally in an extended or locking position. The locking members 206, 208 are retained in a heel block 300 by means of a modified dovetail, with mating flanges 302 being inserted within slots 301 of the heel block 300. The slots 301 in the heel block 300 are wider than the mating flange 302 on the two locking arms 206, 208. As shown in FIG. 22, heel block 300 also comprises a central cylindrical guide having a threaded inner surface 307. Worm screw 304 is matingly received within the cylindrical guide. Hence, by rotating worm screw 304, an operator can move heel block 300 forwards and backwards. By so doing, the angled cam portion 306 of heel block 300 forces the locking arms 206, 208 between a locked position, when fully extended, and a retracted position, when the locking arms 206, 208 are drawn inwards within housing 202.

Figure 22A:
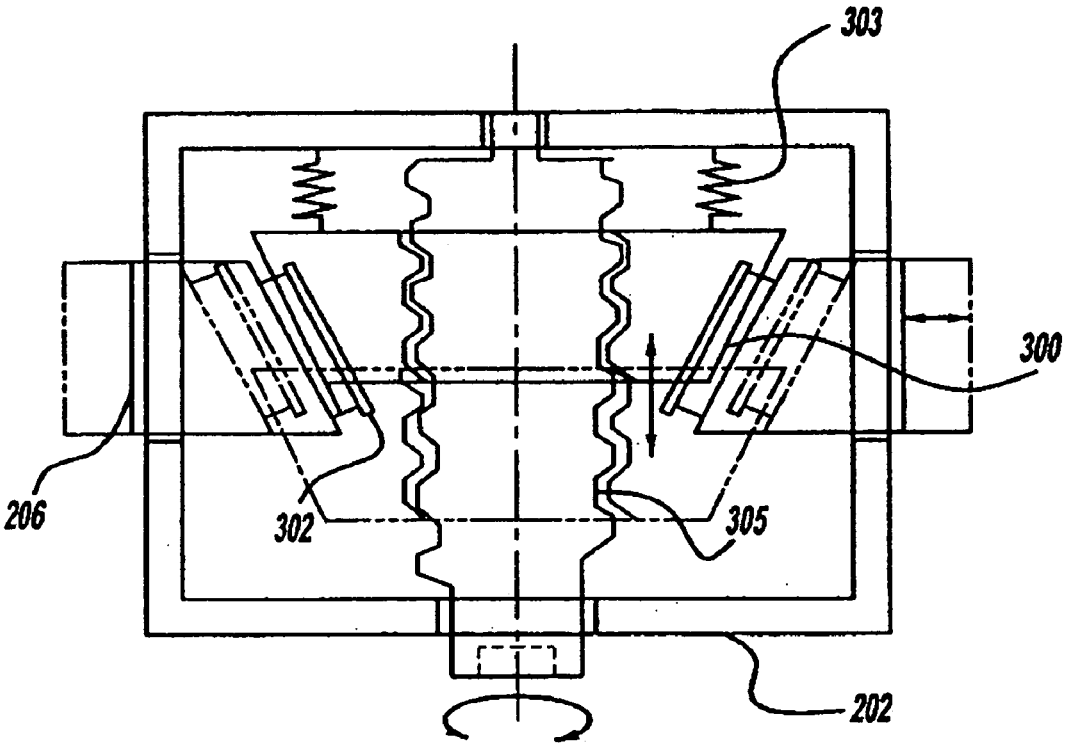
FIG. 22*a* is a cross-sectional view of the second embodiment of the locking mechanism utilized to secure the faucet body housing to the mounting plate.
Figure 23:
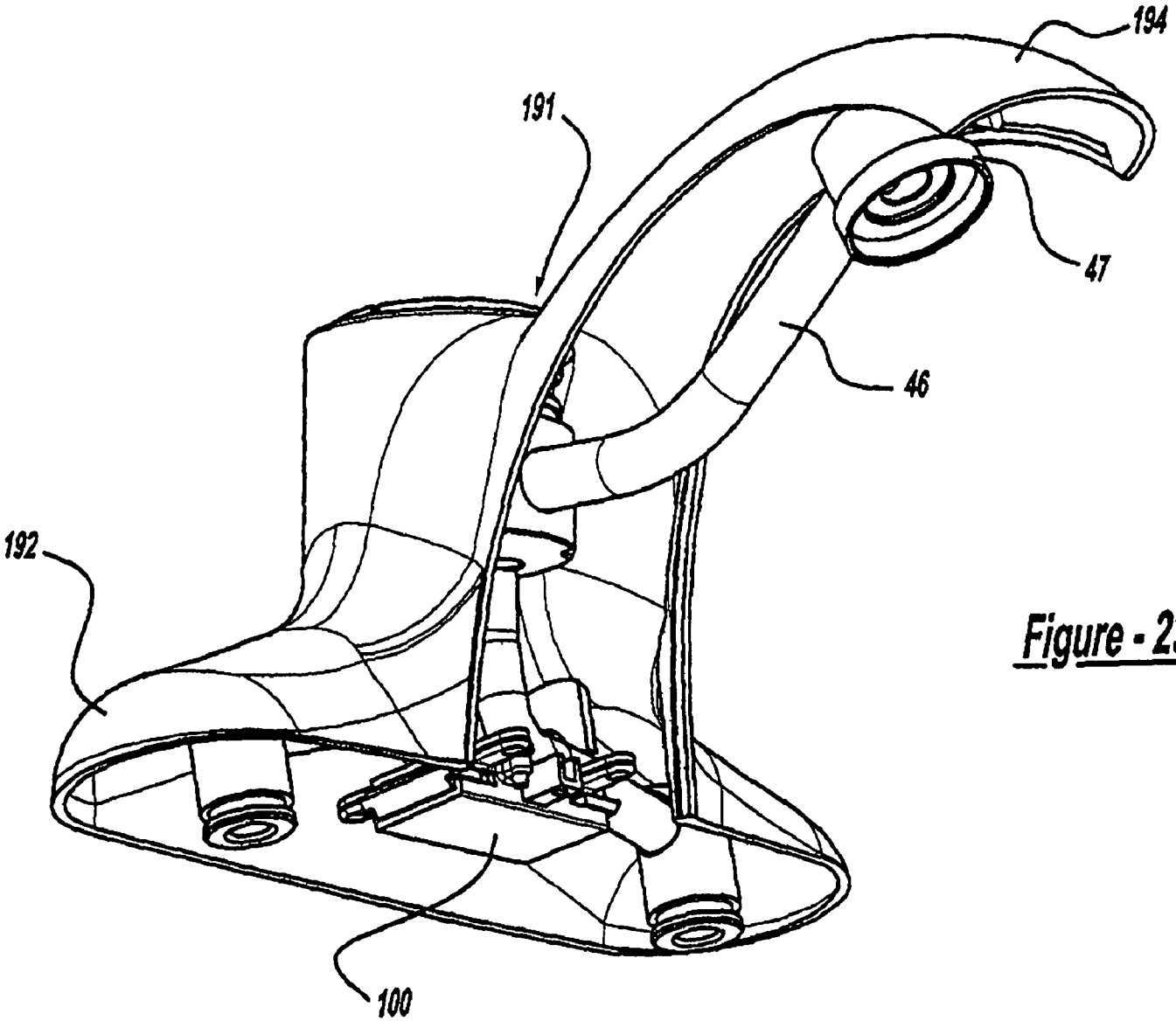
FIG. 23 is a perspective view of a single handle faucet housing, as opposed to a two-handle faucet housing illustrated in FIGS. 1–3, which may be mounted on the mounting plate.

As shown in FIG. 22*a*, biasing members, illustratively springs 303 are mounted behind heel 300 against housing 202. The springs 303 serve to provide some forward pressure on the heel block 300 as the heel block 300 is moved forward in order to lock locking arms 206, 208, effectively "snapping" locking arms 206, 208 into the locked position.

As worm screw 304 is rotated in a clockwise direction, heel block 300 is moved forward within housing 202. The locking arms 206, 208 will be forced out by the angled cam portion 306 of heel block 300, thereby locking the mechanism 200 to the securing members 28, 29.

A groove 305 on worm screw 304 rests in a tab 312 on the housings 201, 202 which allows the worm screw 304 to rotate without changing position. A lock 310 can be used to maintain the worm screw 304 in the locked position.

Figure 24:
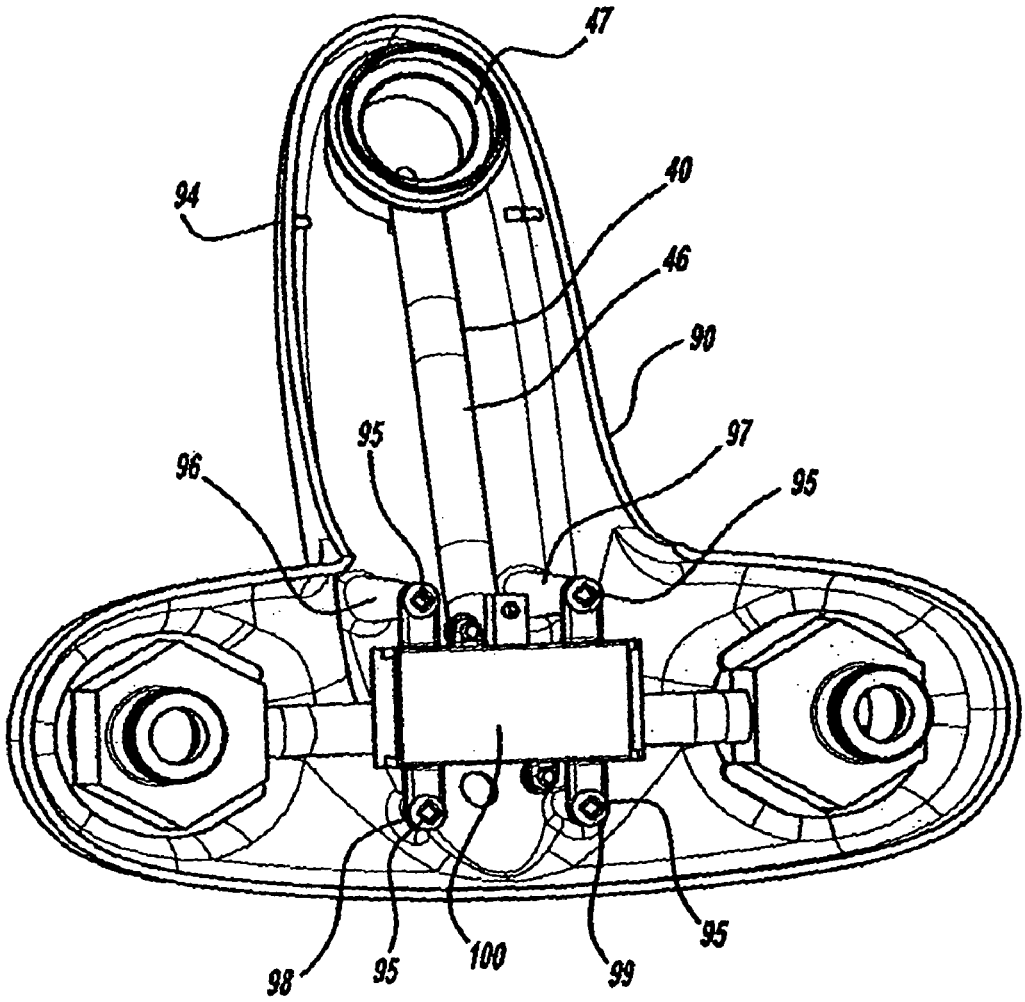
FIG. 24 is a bottom plan view of a faucet body housing containing a waterway with the locking mechanism attached thereto by screws.

As illustrated in FIG. 24 the locking mechanism 100 may be secured to the faucet body housing 90 by screws 95 screwed into bosses 96–99 formed in the underside of faucet body housing 90. However, the attachment means may be employed.

Figure 25:
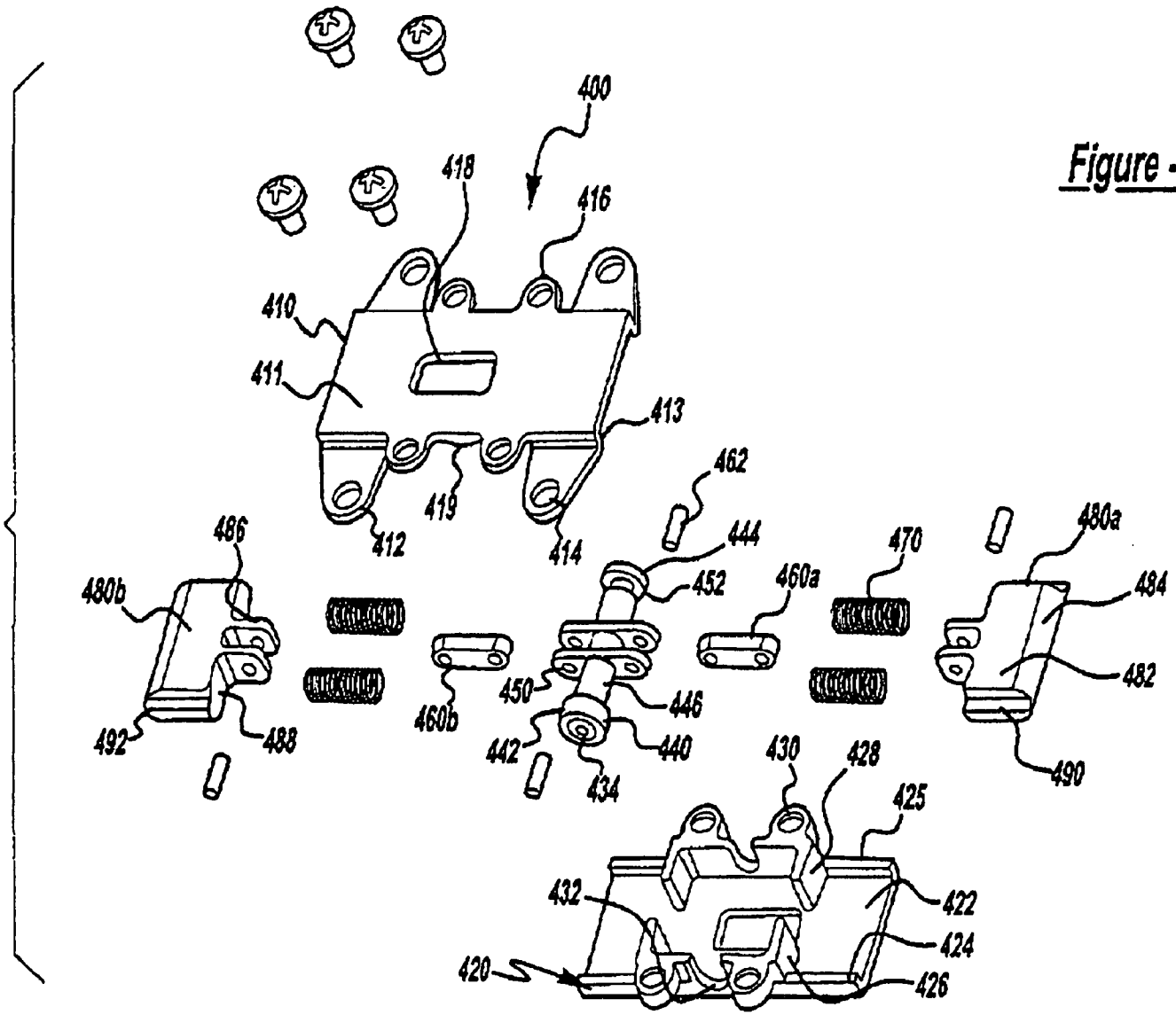
FIG. 25 is an exploded view of an alternate locking mechanism utilized to secure the faucet body housing to the mounting plate.

FIG. 25 illustrates an alternative embodiment of a locking mechanism 400, similar to locking mechanism 100. As shown in FIG. 25, locking mechanism 400 comprises a top cover 410, and a housing 420. The top cover 410 has a body portion 411 having a slot 418 located therein. A ledge 413 extends downwards from the edges of the top cover 410 at each of the four corners. Mounting arms 412 extend outwards from the ledges 413 at the four corners of the top cover 410, the mounting arms 412 having mounting holes 414 for attaching the locking mechanism 400 to the faucet housing body 90. The top cover further has attachment holes 416 for securing the top cover 410 to the housing 420. As shown in FIG. 25, downwardly extending nodes 419 are located between the attachment holes 416.

The housing 420 comprises a main body portion 422 having upwardly extending supports 424 at the four corners of the housing 420, each support having a top surface 425. A slot 426 is located in the main body portion 422. Upwardly extending inner walls 428 form a partially enclosed passageway within the housing 420. Extending outwards from the inner walls 428 are attachment tabs 430 which correspond to the attachment holes 416 of the top cover 410. Inward of the attachment tabs 430 are retaining grooves 432.

Enclosed within the housing 420 is a cam bolt 440, linkage arms 460*a* and 460*b*, paired biasing members, illustratively springs 470, and outwardly extending locking arms 480. The cam bolt 440 has an operating end 442 and an attachment end 444. A cylindrical shaft 446 runs between the operating end 442 and the attachment end 444. Attachment wings 448 having holes 450 extend outwards from the cylindrical shaft 446. A groove 452 is cut into the cylindrical shaft 446 adjacent the attachment end 444. A recess 454 is situated in the operating end 442 of the cam bolt 440 for receiving a tool to turn the cam bolt 440 in the desired direction.

The linkage arms 460*a* and 460*b* are attached to the cam bolt 440 via pins 462 at one end, and to the locking arms 480*a* and 480*b* at the other outside end. Although pins are described herein, other attachment means may be used for attaching the linkage arms 460 to the cam bolt 440. The locking arms 480*a* and 480*b* extend outwards from the housing 420, and are attached to the linkage arm 460*a* and 460*b*, respectively. The locking arms 480*a*, 480*b* comprise body portion 482 having a top surface 482*a* and a bottom surface 482*b*, and having downwardly sloping edges 484 at the outside end of the top surface 482*a*. The inside end of the body portion 482 has an attachment point 486 for receiving the linkage arms 460. Adjacent the attachment point 486 is recesses 488 for receiving the springs 470. Wing ledges 490 protrude outwards from the body portion 482 of the locking arms 480. The outside end of the bottom surface 482*b* also has an upwardly angled edge 492.

In operation, the top cover 410 is attached to the housing 420. Once attached, the downwardly extending ledge 413 and the upwardly extending support 424 form a guide slot 425*a* for receiving the locking arms 480*a* and 480*b*. The downward extending node 419 serves to lock the cam bolt 440 within the groove 432. The assembled locking mechanism 400 is then installed within the faucet housing body 90. Once the mounting plate 21 is installed on top of the sink ledge or countertop 10, the locking mechanism 400 may be installed onto the mounting plate 21 by simply aligning the faucet body housing 90 over the mounting plate 21 and pressing the faucet body housing 90 into place. As the locking mechanism 400 is pressed into position, the bottom sloping surfaces 492 of the locking arms 480 abut the sloping leading ledge 30 of the mounting plate 21. This bottom sloping surface 492 assists the locking arms 480 to retract into the locking mechanism 400. As the locking arms 480*a* and 480*b* retract, compressing the spring pairs 470 against the upwardly extending inner wall 428, the locking arms 480*a* and 480*b* rotate the wings 450 of the cam bolt 440 in a clockwise direction, thereby displacing the linkages

460*a* and 460*b*. When the cam bolt 440 is rotated in the clockwise direction, the linkages 460*a* and 460*b* pass through the slots 426 and 418, respectively. Once the locking arms 480*a* and 480*b* pass by the inwardly angled arm 29, the spring pairs 470 force the locking arms 480*a* and 480*b* into the extended position. The installer may next insert a suitable tool into the recess 454 to rotate the cam bolt 440 in a counterclockwise direction to lock the locking arms in the extended position. The top cover 410 and the housing 420 prevent the cam bolt 440 from rotating past the locked position, thereby preventing the linkage arms 460*a* and 460*b* from retracting the locking arms 480*a* and 480*b* via counterclockwise rotation.

Although the cam bolt 440 in the above-described embodiment is oriented in the horizontal direction, it is also envisioned that the locking arms 480*a* and 480*b* may be rotated using a cam bolt or other similar device placed in a vertical or other suitable orientation. Also, the cam bolt 440 may be used to extend the locking arms 480*a* and 480*b* without the use of the linkage arms 460*a* and 460*b*.

Although the invention has been described in detail with reference to certain preferred embodiments, variations and modifications exist within the spirit and scope of the invention as described and defined in the following claims.

The invention claimed is:

1. A top mounting faucet assembly comprising:

a mounting plate adapted to be securely and removably mounted to a sink, the sink having a top surface and an under surface, the mounting plate having a plurality of fluid conduits extending downwards away from the sink surface, and also having attachment means for securing the mounting plate to the sink surface;

a waterway tube, the waterway tube having a plurality of fluid tubes that are in fluid communication with the fluid conduits of the mounting plate;

a faucet body housing, the faucet body housing having an upper surface and an open end, the faucet body being adapted to fit over the waterway tube and to attach to the mounting plate; and a locking mechanism, the locking mechanism being releasably secured to the mounting plate and releasably secured to the faucet body housing, thereby locking the faucet body housing to the mounting plate, the locking mechanism including:

a heel block having a body portion and wing portions extending outwards from the body portion, each wing portion having a sloping leading edge and a slot cut therethrough, and a pair of locking arms extending outward from opposing ends of the locking mechanism, each locking arm having an attachment end and an engagement end, and further having a mating flange extending from the attachment end of the locking arm, the mating flanges being receivable within the slots in the sloping leading edges of the wing portions of the heel block.

2. The top mounting faucet assembly of claim 1, further comprising an undercover plate to cover the open end of the faucet body housing.

3. The top mounting faucet assembly of claim 2, wherein the mounting plate comprises:

a first fluid conduit;

a second fluid conduit;

a base plate having a top surface and a bottom surface, the first and second fluid conduits exiting up through the base plate via openings in the base plate;

attachment posts adjacent to each fluid conduit;

mounting plate locking members; and wherein the first and second fluid conduits are connected to fluid supply lines for supplying fluid to the faucet assembly.

4. The top mounting faucet assembly of claim 3, wherein the attachment posts have an outer surface, the outer surface having external threads thereon, and wherein the mounting plate locking members are threadedly attached to the attachment posts, so that as the attachment posts are rotated in a clockwise manner, the mounting plate locking members are urged up the attachment posts until the mounting plate locking members come into contact with the under surface of the sink, so as to firmly secure the mounting plate to the sink.

5. The top mounting faucet assembly of claim 4, wherein the mounting plate locking members have an outwardly-extending body having a guide surface and an outer surface, an attachment end attached around the attachment post, and a ledge located at the end opposite the attachment end, and wherein the guide surfaces abut the first and second fluid conduits, thereby preventing the mounting plate locking member from rotating with the attachment post.

6. The top mounting faucet assembly of claim 2, wherein the first and second fluid conduits have threaded outer surfaces, for direct mounting of the mounting plate to the sink using compatible threaded means.

7. The top mounting faucet assembly of claim 3, wherein the mounting plate further comprises a plurality of securing members, each securing member having an upwardly extending tab portion and an inwardly angled arm portion, the arm portion having a sloping edge surface.

8. The top mounting faucet assembly of claim 1, wherein the locking mechanism further comprises:

a top cover having a plurality of attachment points thereon; and a bottom cover removably attachable to the top cover, the bottom cover also having a plurality of attachment points corresponding to the attachment points of the top cover.

9. The top mounting faucet assembly of claim 1, wherein:

the heel block of the locking mechanism contains a central cylindrical guide having a threaded inner surface, and further comprising a worm screw, the worm screw being matingly received within the cylindrical guide, such that, as the worm screw is rotated, the heel block is moved forward, urging the locking arms to an extended position, and aft, urging the locking arms to a retracted position.

10. The top mounting faucet assembly of claim 9, wherein:

the locking mechanism further includes a top cover, and a bottom cover removably attachable to the top cover, the bottom cover having upwardly extending side walls; and the worm screw has a threaded shank portion and a head portion, the head portion having a circumferential groove therein, the worm screw being located so that the upwardly extending side wall of the bottom cover is received within the circumferential groove, thereby anchoring the worm screw with respect to the bottom cover so that when the worm screw is rotated, the worm screw does not change position relative to the bottom cover.

11. The top mounting faucet assembly of claim 1, wherein the locking mechanism further includes a plurality of spring members anchored behind the heel block, urging the heel block towards a forward position, thereby urging the locking arms towards an extended position.

12. A top down faucet mounting assembly comprising:

a mounting base configured to be removably mounted to a sink;

a faucet body housing configured to be positioned above the mounting base; and a locking mechanism operably coupled intermediate the mounting base and the faucet body housing, the locking mechanism including:

a heel block;

a pair of locking arms extending outward from opposing ends of the locking mechanism; and a worm screw operably coupled to the heel block, such that, as the worm screw is rotated in a first direction, the heel block is moved forward, urging the locking arms to an extended position, and as the worm screw is rotated in a second direction, the heel block is moved aft, urging the locking arms to a retracted position.

13. The top down faucet mounting assembly of claim 12, further comprising:

a plurality of biasing members operably coupled to the locking arms, the plurality of biasing members being anchored behind the heel block, urging the heel block towards a forward position, thereby urging the locking arms towards an extended position.

14. The top mounting faucet assembly of claim 12, wherein the locking mechanism further comprises a top cover having a plurality of attachment points thereon, and a bottom cover removably attachable to the top cover, the bottom cover also having upwardly extending sidewalls; and the worm screw has a threaded shank portion and a head portion, the head portion having a circumferential groove therein, the worm screw being located so that the upwardly extending side wall of the bottom cover is received within the circumferential groove, thereby anchoring the worm screw with respect to the bottom cover so that when the worm screw is rotated, the worm screw does not change position relative to the bottom cover.

* * * * *